US011583477B2

(12) United States Patent
Herman et al.

(10) Patent No.: US 11,583,477 B2
(45) Date of Patent: Feb. 21, 2023

(54) MEDICATION DISPENSING SYSTEM

(71) Applicant: Papapill LLC, Plymouth, MN (US)

(72) Inventors: Randy Herman, Plymouth, MN (US); Connor Herman, Plymouth, MN (US); Tyler Herman, Plymouth, MN (US); Jarrod Eliason, Plymouth, MN (US); Micah Somers, Plymouth, MN (US)

(73) Assignee: Papapill, LLC, Plymouth, MN (US)

( * ) Notice: Subject to any disclaimer, the term of this patent is extended or adjusted under 35 U.S.C. 154(b) by 201 days.

(21) Appl. No.: 16/914,879

(22) Filed: Jun. 29, 2020

(65) Prior Publication Data

US 2020/0405578 A1 Dec. 31, 2020

Related U.S. Application Data

(60) Provisional application No. 62/868,596, filed on Jun. 28, 2019.

(51) Int. Cl.
*A61J 7/00* (2006.01)
*A61J 7/04* (2006.01)

(52) U.S. Cl.
CPC ..... *A61J 7/0436* (2015.05); *A61J 7/0069* (2013.01); *A61J 7/0084* (2013.01); *A61J 2200/70* (2013.01); *A61J 2205/10* (2013.01); *A61J 2205/50* (2013.01)

(58) Field of Classification Search
CPC ..... A61J 7/0436
See application file for complete search history.

(56) References Cited

U.S. PATENT DOCUMENTS

| | | | | |
|---|---|---|---|---|
| 4,444,212 | A | 4/1984 | Ristvedt et al. | |
| 5,097,652 | A | 3/1992 | Inamura et al. | |
| 5,097,982 | A | 3/1992 | Kedem et al. | |
| 5,472,113 | A | 12/1995 | Shaw | |
| 5,713,485 | A | 2/1998 | Liff et al. | |
| 6,263,259 | B1 | 7/2001 | Bartur | |
| 6,564,121 | B1 | 5/2003 | Wallace et al. | |
| 7,048,141 | B2 | 5/2006 | Abdulhay et al. | |
| 8,989,893 | B2 | 3/2015 | Jones et al. | |
| 9,542,534 | B1 | 1/2017 | Ducatt et al. | |
| 9,550,619 | B2 | 1/2017 | Park, IV | |
| 9,579,264 | B1 | 2/2017 | Litton | |
| 10,198,556 | B2 | 2/2019 | Herman et al. | |
| 2003/0005800 | A1 | 1/2003 | Czarnek et al. | |
| 2003/0036683 | A1 | 2/2003 | Kehr et al. | |
| 2003/0089731 | A1* | 5/2003 | Mayer | B01L 3/502 221/279 |
| 2003/0183642 | A1 | 10/2003 | Kempker, Sr. | |
| 2005/0240305 | A1 | 10/2005 | Bogash et al. | |
| 2006/0058724 | A1 | 3/2006 | Handfield et al. | |
| 2006/0163271 | A1 | 7/2006 | Hatsuno et al. | |
| 2006/0266763 | A1 | 11/2006 | Svabo Bech | |
| 2007/0023444 | A1 | 2/2007 | Holloway et al. | |

(Continued)

*Primary Examiner* — Gene O Crawford
*Assistant Examiner* — Ayodeji T Ojofeitimi
(74) *Attorney, Agent, or Firm* — Taft Stettinius & Hollister LLP

(57) ABSTRACT

A pill dispensing apparatus includes a carousel with at least one removable bin for storing pills, a vision system for identifying pills within the bin, a vacuum nozzle for removing one or more pills identified by the vision system, and a dispensing area for receipt of the removed pills.

20 Claims, 24 Drawing Sheets

(56) References Cited

U.S. PATENT DOCUMENTS

| | | | | |
|---|---|---|---|---|
| 2007/0208454 | A1* | 9/2007 | Forrester | G07F 9/006 700/216 |
| 2008/0027579 | A1 | 1/2008 | van der Hoop | |
| 2009/0105876 | A1 | 4/2009 | Simpson et al. | |
| 2009/0281657 | A1 | 11/2009 | Gak et al. | |
| 2010/0140287 | A1 | 6/2010 | Richardson et al. | |
| 2010/0184861 | A1 | 7/2010 | Politi et al. | |
| 2010/0256808 | A1 | 10/2010 | Hui | |
| 2011/0178634 | A1 | 7/2011 | Yuyama et al. | |
| 2012/0204522 | A1 | 8/2012 | Kondo et al. | |
| 2014/0097195 | A1* | 4/2014 | Anthony | G16H 20/13 221/13 |
| 2014/0214200 | A1 | 7/2014 | Chrusciel et al. | |
| 2014/0244033 | A1 | 8/2014 | Ucer et al. | |
| 2015/0028050 | A1* | 1/2015 | Huang | A61J 7/0076 221/211 |
| 2016/0158107 | A1* | 6/2016 | Dvorak | A61J 7/0007 221/9 |
| 2019/0333620 | A1 | 10/2019 | Herman et al. | |

* cited by examiner

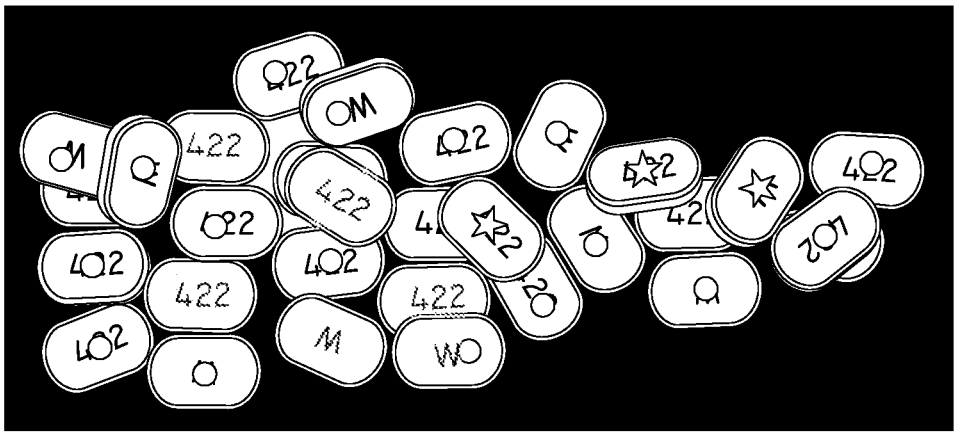
WO
M
422
422
422

MEDICATION DISPENSING SYSTEM

CROSS-REFERENCE TO RELATED APPLICATION

The present application claims the benefit of the filing date of U.S. Provisional Application Ser. No. 62/868,596 filed on Jun. 28, 2019, which is incorporated herein by reference in its entirety for all purposes.

FIELD OF THE INVENTION

The present disclosure relates to a dispensing apparatus and method, and in particular to one having multiple bins on a rotating carousel, with an optical selection camera and system, and a vacuum selector all to select and dispense doses from multiple pills located in the bins.

BACKGROUND

Many patients are required to take different combinations and amounts of pills at different times throughout the day. Pills can include medicines, vitamins, nutritional supplements, contraceptives, and the like. Compliance with such complicated dosage regimens is often challenging, and failure to follow the regimen can have significant adverse effects on the patient. Further, many patients may have physical or mental conditions that complicate the ability to accurately determine what medicines need to be taken at what times.

Complicated regimens can be difficult for anyone to follow and a challenge for those suffering from impaired mental capacity, judgment, or memory—whether that is a short-term condition brought on by the condition being treated or a long-term chronic situation.

Another challenge is that many pills come in similar shapes, colors, and sizes making it very difficult for people to distinguish between them, which can cause mistakes with serious consequences. On the opposite extreme, many pills have very different shapes, colors, and sizes, which may assist people in distinguishing them, but makes it extremely difficult for machines to identify and select between such extremes. Also, prior art devices are difficult to load, unreliable in operation, and of limited utility in both home and professional environments.

As a result, an improved apparatus and system for the delivery of pills that substantially eliminates the problems of the prior art is needed.

SUMMARY

The present disclosure is directed to a pill dispensing apparatus. The pill dispensing apparatus includes a carousel with at least one removable bin for storing pills, a vision system for identifying pills within the bin, a vacuum nozzle for removing pills identified by the vision system, and a dispensing area for receipt of the removed pills.

Another embodiment is a unique pill dispensing system. Other embodiments include apparatuses, systems, devices, hardware, methods, processes, computer-related components of computer-implemented instructions, and combinations for pill dispensing devices and related components. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein:

FIGS. 12-19 show various images processed for the dispensing apparatus according to the present disclosure.

DETAILED DESCRIPTION

Figure 1:
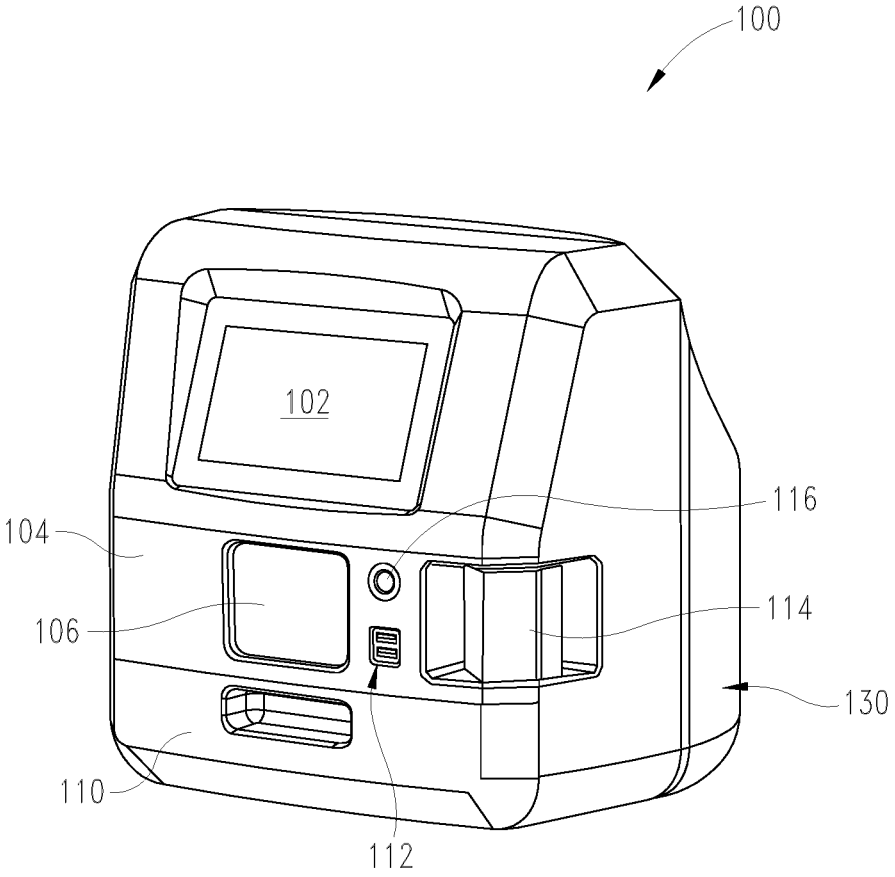
FIG. 1 is a perspective front view of a dispensing apparatus according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In FIGS. 1-11D, a dispensing apparatus for pills and embodiments thereof are shown. FIG. 1 shows a front perspective view of the device 100. The device 100 is a self-contained storage and dispensing apparatus for dispensing pills, medicaments, vitamins, supplements, and the like (collectively referred to herein as "pills" or "medicine").

Figure 2:
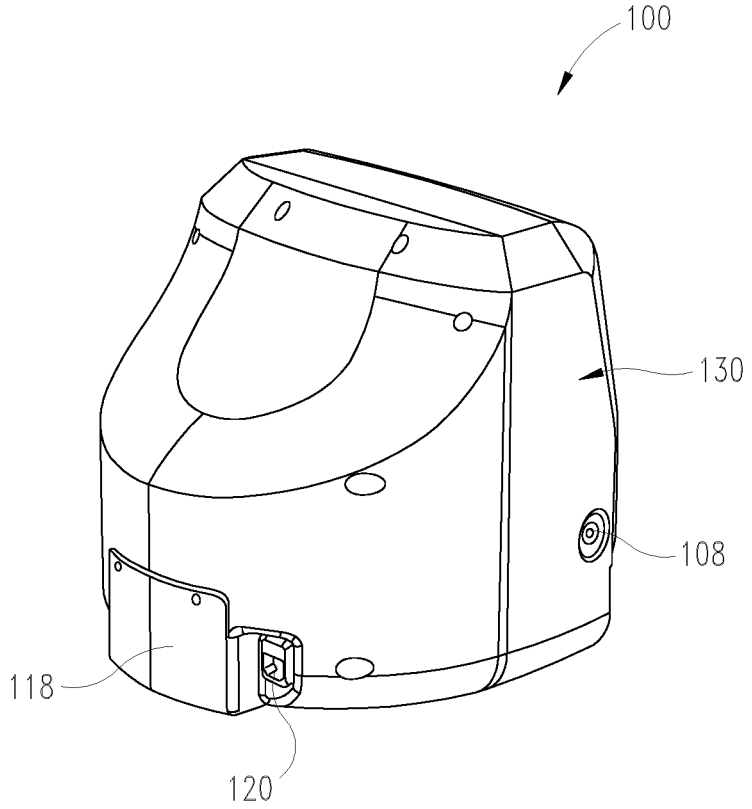
FIG. 2 is a perspective rear view of the dispensing apparatus FIG. 1.
Figure 4:
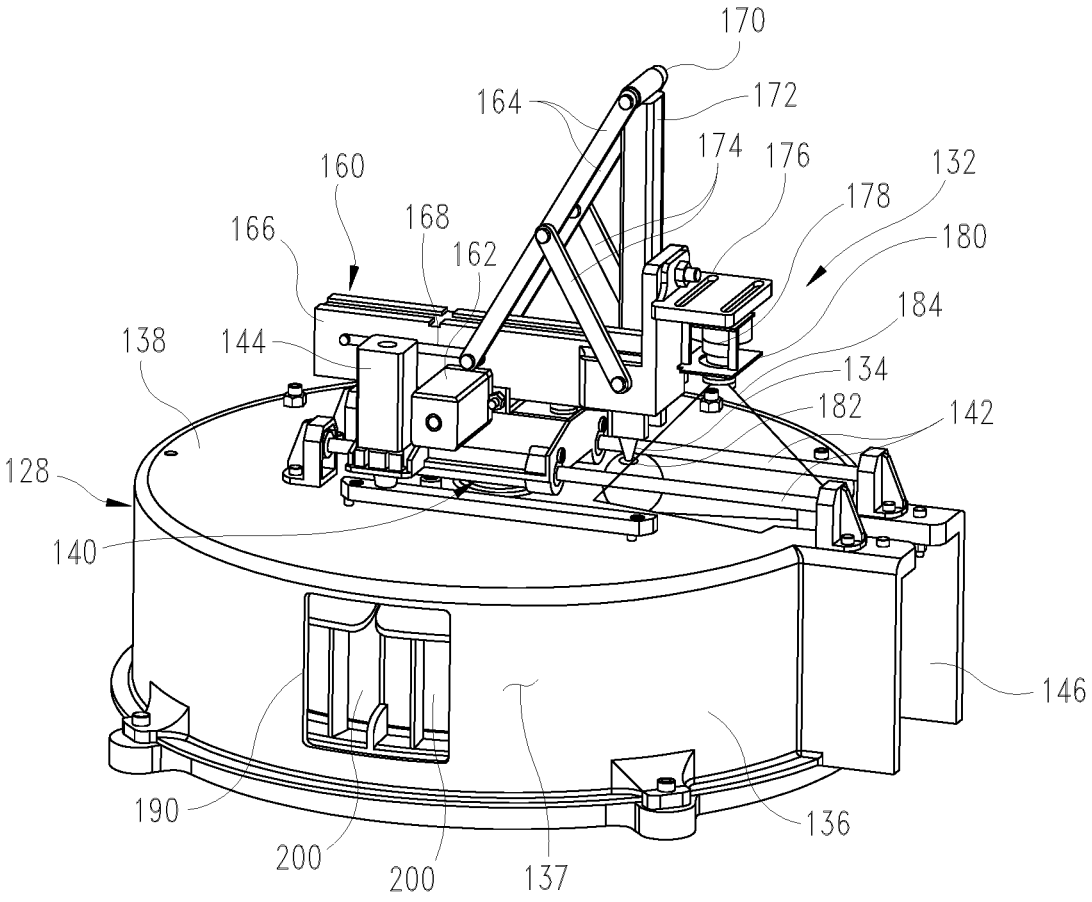
FIG. 4 is a perspective view of one embodiment of a carousel of the dispensing apparatus according to the present disclosure.

The device 100 may be operated under computer control via a conventional CPU, and software instructions encoded on a computer readable medium, as described below. A touch-enabled user interface such as a touch screen 102 is provided on the front 104 of the device 100, which allows a user to interact with, operate, and configure the device 100. The device 100 includes an outside cover 130, and a bin access door 106 removably covering an opening 190 through which the user can access an aligned one of the internal bins 200 that store the pills (FIG. 4). Access to the bins 200 is controlled by a lock 108, as shown in FIG. 2. Unlocking of the bin access door 106 can be achieved through computer control through use of the touch screen 102, or manually using a physical key.

Below the bin access door 106 is a drawer/tray 110 that can be used for general storage. Specifically, drawer 110 can be used to store items that are not in pill form or that are too large or oddly sized to be dispensed as set forth below. This can include pills, medicine, ointments, liquids, inhalers, and the like. The drawer 110 can be unlocked under computer control through use of the touch screen 102, or manually with a physical key.

The device 100 includes USB ports 112 that can be used for general purposes, like connecting a keyboard or mouse (not shown), transferring data to a USB flash drive (not shown), or to interface with the computer of the device 100 for any convenient purpose. For example, the device 100 can interface with electronic monitoring equipment such as a pulse oximeter, thermometer, heart rate monitor, blood pressure monitor or other similar device for the purpose of determining appropriate dosage of a pill or providing information to a health care professional for telemedicine purposes. The device 100 may be equipped with a hard wired or wireless internet connection for connectivity to outside computer networks including the internet.

The device 100 may be adapted for use as a home healthcare kiosk system and can be used to bring healthcare services into the user's home by providing one or more of the technologies of telemedicine, telehealth and medication management.

Telemedicine can be viewed as the use of electronic communications and software to provide clinical services to patients by providing a two-way, real time interactive communication between the patient and the physician or practitioner. Telemedicine technology is frequently used for follow-up visits, management of chronic conditions, medication management, specialist consultation and a host of other clinical services that can be provided remotely via secure video and audio connections.

To support the telemedicine service the device 100 can be configured to accept different diagnostic tools that are typically used during doctor visits. For example, such devices may include: pulse oximeters, heart monitors, blood glucose monitoring, temperature probes, and others. The device 100 can transmit the results from the diagnostic tools to the physician during a call or video meeting and be able to provide more information about the current patient's situation than may be available from a visit to the doctor by the patient.

Telehealth (also known as e-health or m-health) is the use of remote non-clinical services, such as provider training, administrative meetings, and continuing medical education, in addition to clinical services. According to the World Health Organization, telehealth includes, "Surveillance, health promotion and public health functions." For more about telehealth and it's benefits see: https://www.mayoclinic.org/healthy-lifestyle/consumer-health/in-depth/telehealth/art-20044878

Medication management involve management of the wide varieties of medications and dosage frequencies in which patients are required to take multiple pills in a day at various times throughout the date. Device 100 can be used to remind the patient when and which medications are required to be taken at the frequency prescribed by the physician. The device 100 can notify the patient when medications are ready, and can track and trend how frequently medications are not taken by the patient.

The device 100 includes a dispensing cup 114 where pill(s) are dispensed from the internal bin(s) 200 and placed for access by the user. The presence of the dispensing cup 114 is monitored by the system to prevent dispensing of pills without the cup 114 in place and to detect when the user has removed the cup 114 after dispensing. The dispensing cup 114 is also used as a notification tool to the user when medication is ready for consumption. The cup 114 may be manufactured in a clear biocompatible material and be illuminated via a LED light. When medication is ready the LED light is turned on which reflects off the clear cup 114 and provides an image that the cup 114 itself is illuminated. This is used as a visual notification tool to the user of the device 100.

The device may also include a button 116 that can be used to wake up the computer from sleep mode, or for powering the device 100 on or off (which can also be done from the touch screen 102.) Button 116 may also be used for a hard reset if necessary.

FIG. 2 shows a rear perspective view of the device 100. The device 110 includes a rear door 118 for access to the battery backup power source. The device 100 runs on AC power, and an AC power receptacle 120 is provided for direct connection to a home's power source, but has battery backup for occasions when power outages may occur to prevent patients from missing dosages at such times. The device 100 may also be operated via battery power alone. As a secondary emergency medication access option, the device 100 includes a bin access door 106 and keyed drawer lock 108, which can be used to unlock the bin access door 106 or drawer in the case of a total power failure or system lock up that cannot be reset. The device 100 may also include a speaker (not shown), which can be used to generate audio indications, play recorded voice instructions, or other purposes.

Figure 3:
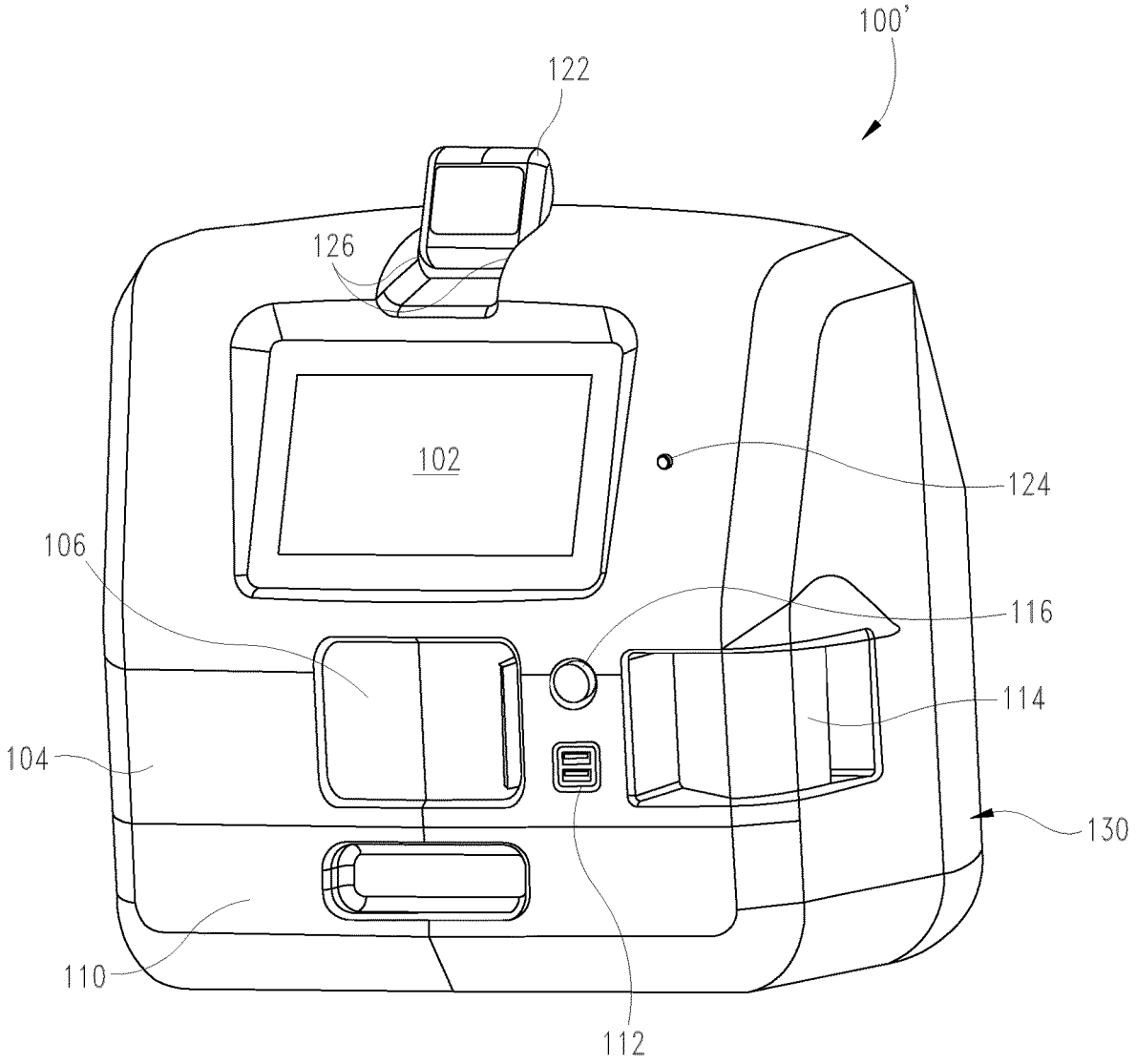
FIG. 3 is a perspective front view of another embodiment dispensing apparatus according to the present disclosure including a camera.

FIG. 3 is a front view of another embodiment of the device, designated as device 100', which may be same as device 100, but includes a front facing camera 122 and microphone 124. The camera 122 is set on hinges 126 and can move between an open position (as shown) and a closed position for security, and it can be adjusted for the correct height as well. The camera 122 can be used to take pictures of pill bottles, information, prescriptions, or instructions that can be stored within the device 100. The camera 122, microphone 124, and speaker can also be used for telemedicine video conferencing, or other purposes.

FIG. 4 is a perspective view of the device 100 with the outside cover 130 removed, showing some of the internal components of the device 100 including a carousel 128. The device 100 uses a camera or vision system 132 to analyze the contents of the bins 200 (FIGS. 11A-11D) and determine which pill to select therefrom, which is described in detail below, and a vacuum nozzle 134 to retrieve the pill from one of the bins 200 and drop it into the dispensing cup 114. The device 100 includes a radial stage 140 mounted on a top wall 138 of a carousel cover 136 of carousel 128, and a Z stage 160 mounted on top of the radial stage 140.

In the embodiment of FIG. 4, the radial stage 140 sits on top of two radial stage guide rods 142 and moves back and forth along the guide rods 142. The radial stage 140 slides along the guide rods 142 with the use of the radial stage motor 144. This enables the radial stage 140 to move from the center of the device 100 (where the pill bin storage is located) then outward to the edge of the device 100 to the dispensing cup 114 located in dispensing cup area 146, (where the pills are dispensed to allow the patient access to their medication) and back. This operation is repeated each time a medication needs to be taken from a pill bin 200 and transferred to the dispensing cup 114.

The Z stage 160 sits on top of the radial stage 140, and the Z stage motor 162 drives the vacuum nozzle 134 up and down. The Z stage 160 includes two long legs 164 on each side of the Z stage 160 that slide along and pivot in a slot 168 at the bottom 166 of the Z stage 160 and pivot at the top 170 of a vertical column 172. Two shorter legs 174 on each side of the Z stage 160 pivot at the bottom 166 of the Z stage 160 at column 172 and pivot at the middle of the long legs 164. The bottoms of the long legs 164 pivot by sliding in the slot 166 at the back of the Z stage 160. The Z stage motor 162 drives the vertical column 172 down by moving the bottom pivot of the long legs 164 horizontally away from the bottom pivot of the short legs 174. Conversely, the Z stage motor 162 drives the vertical column 172 up by moving the bottom pivot of the long legs 164 horizontally toward the bottom pivot of the short legs 174. Generally, the legs 164, 174 provide stability and support.

Vision system 132 includes a camera mount 176 is attached to the vertical column 172, and a camera 178 is attached to the camera mount 176. A light 180 may also attached to the camera mount 176, and may be provided in connection with a printed circuit board of the camera 178. The vacuum nozzle 134 is attached to the vertical column 172. In FIG. 4, a spherical pill 182 is shown attached to the vacuum nozzle 134 for illustration purposes. The viewing angle 184 of the camera 178 is also depicted in FIG. 4 as a cone.

Thus, the vacuum nozzle 134 and the camera 178 can move radially, meaning from the center of the device 100 outward and back, and the vacuum nozzle 134 can move in the Z direction, meaning up and down. Two motors 144, 162 are provided. The radial stage motor 144 is operable to move the stages 140, 160 and vacuum nozzle 134 and camera 178 radially, and a Z stage motor 162 is operable to move the Z stage 160 and the nozzle 134 and camera 178 in the Z direction. The Z stage 160 can move the vacuum nozzle 134 far enough downward to retrieve a pill at the bottom of a bin 200, and the radial stage 140 moves the nozzle 134 radially to retrieve a pill that is located radially anywhere in the bin 200. The radial stage 140 also moves far enough to the perimeter of the device 100 to drop the pill in the dispensing cup 114, which is located at the outside edge of the device 100 in dispensing area 146 beyond the edge of the bins in the carousel 128.

The radial and Z stages 140, 160 are mounted to carousel cover 136, which covers the bins 200 to ensure the pills in the bins cannot escape into other bins or into the interior of the device 100. The carousel cover 136 has an opening 186 (FIG. 5) under the camera 178 and vacuum nozzle 134 to allow access to the pills for the vision system 132 and for retrieving the pills. The carousel 128 has an empty bin 200 that is stationed under this opening, when the system is in the home position, to ensure that no pills can escape the device 100. This alleviates the need for the carousel 128 to have a retractable cover through which the nozzle 134 can move.

Figure 5:
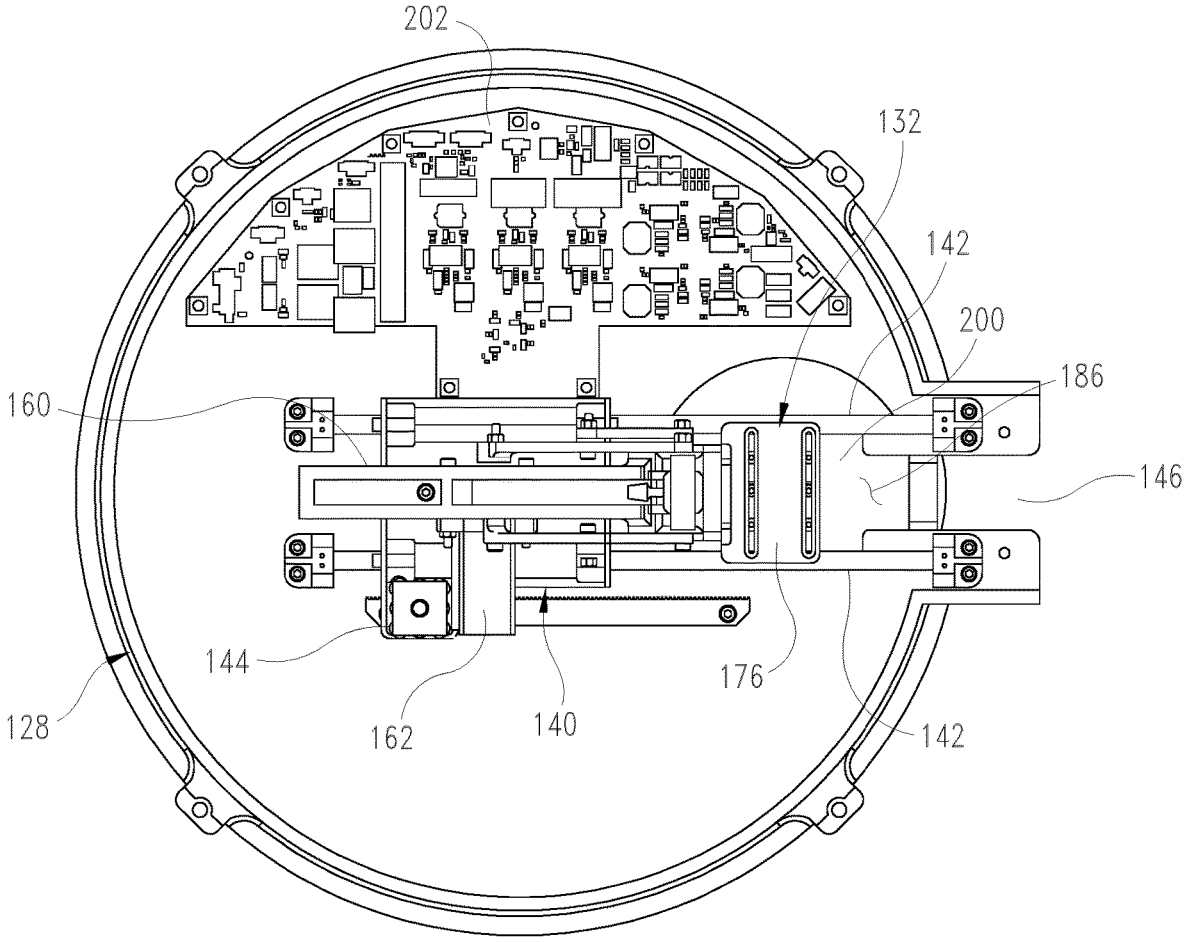
FIG. 5 is a plan view one embodiment of the carousel of the dispensing apparatus of FIG. 4.

FIGS. 4-5 show that the carousel cover 136 includes a sidewall 137 extending from top wall 138 to enclose the bins 200 of carousel 128. The sidewall 137 has a bin access door opening 190 that corresponds in location to the bin access door 106 shown in FIG. 1. This allows for removing and inserting the bins 200 from the carousel 128. A portion of the bins 200 is visible in FIG. 4 through opening 190 in sidewall 137. The sidewall 137 also has dispensing cup area 146 for placing the dispensing cup 114 into which the pills are dropped when retrieved from the bins 200.

Figure 6:
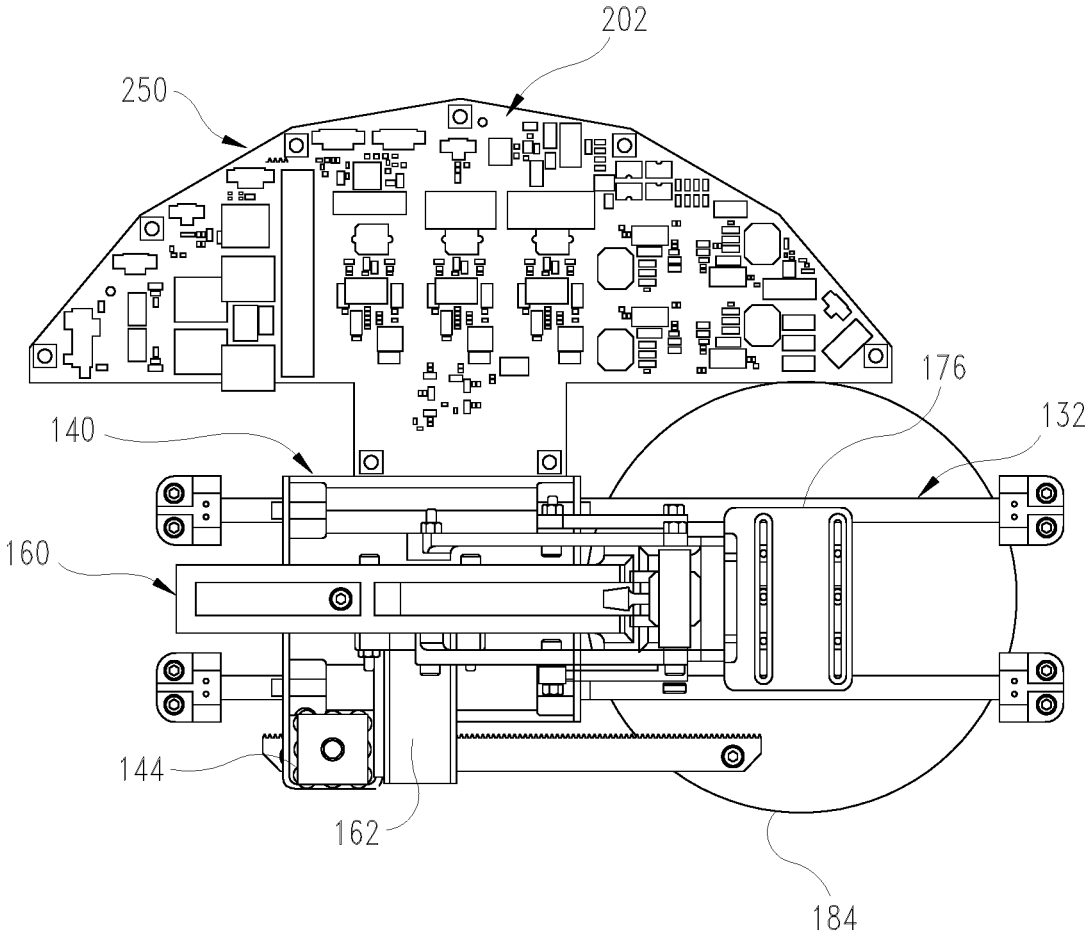
FIGS. 6-9 are various views of the radial and Z stage mechanisms of the dispensing apparatus of FIG. 4.
Figure 7:
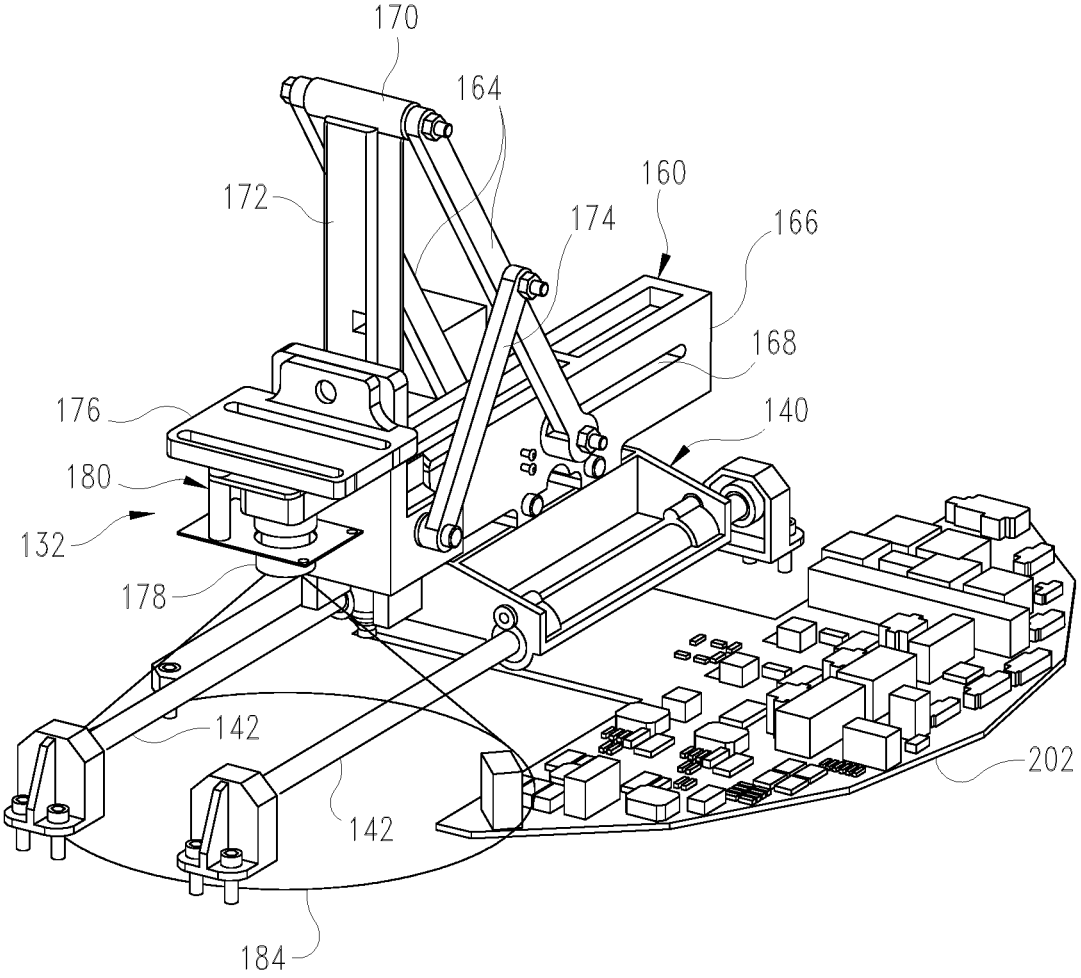
Figure 8:
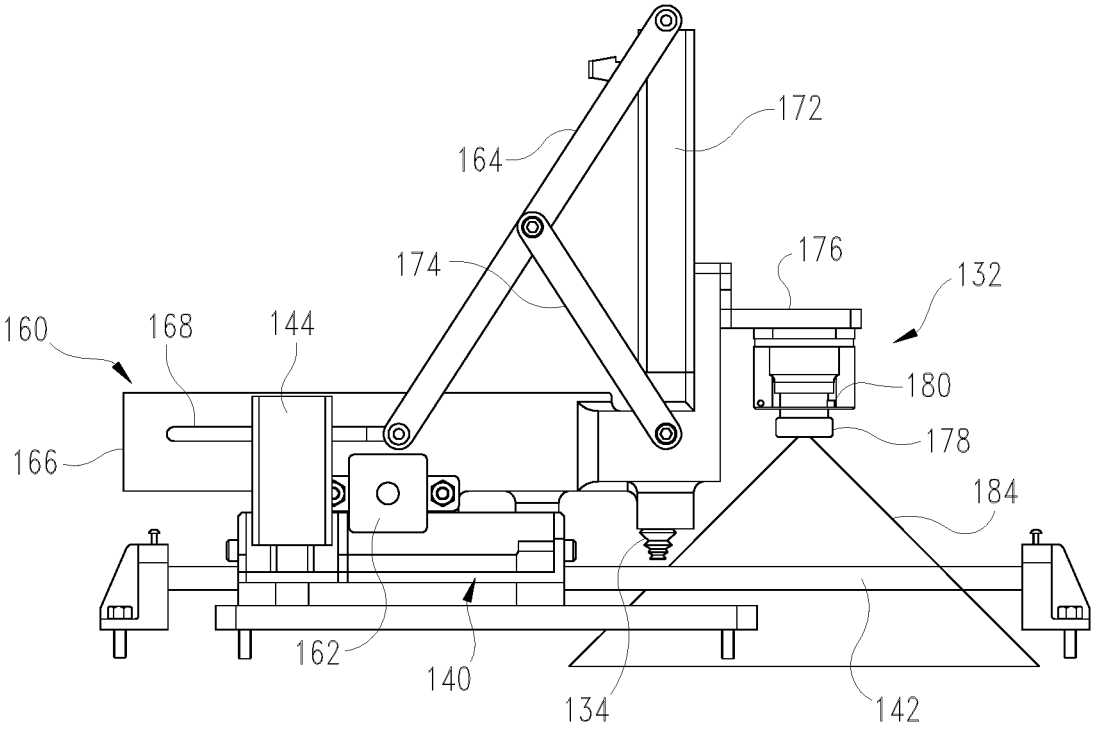
Figure 9:
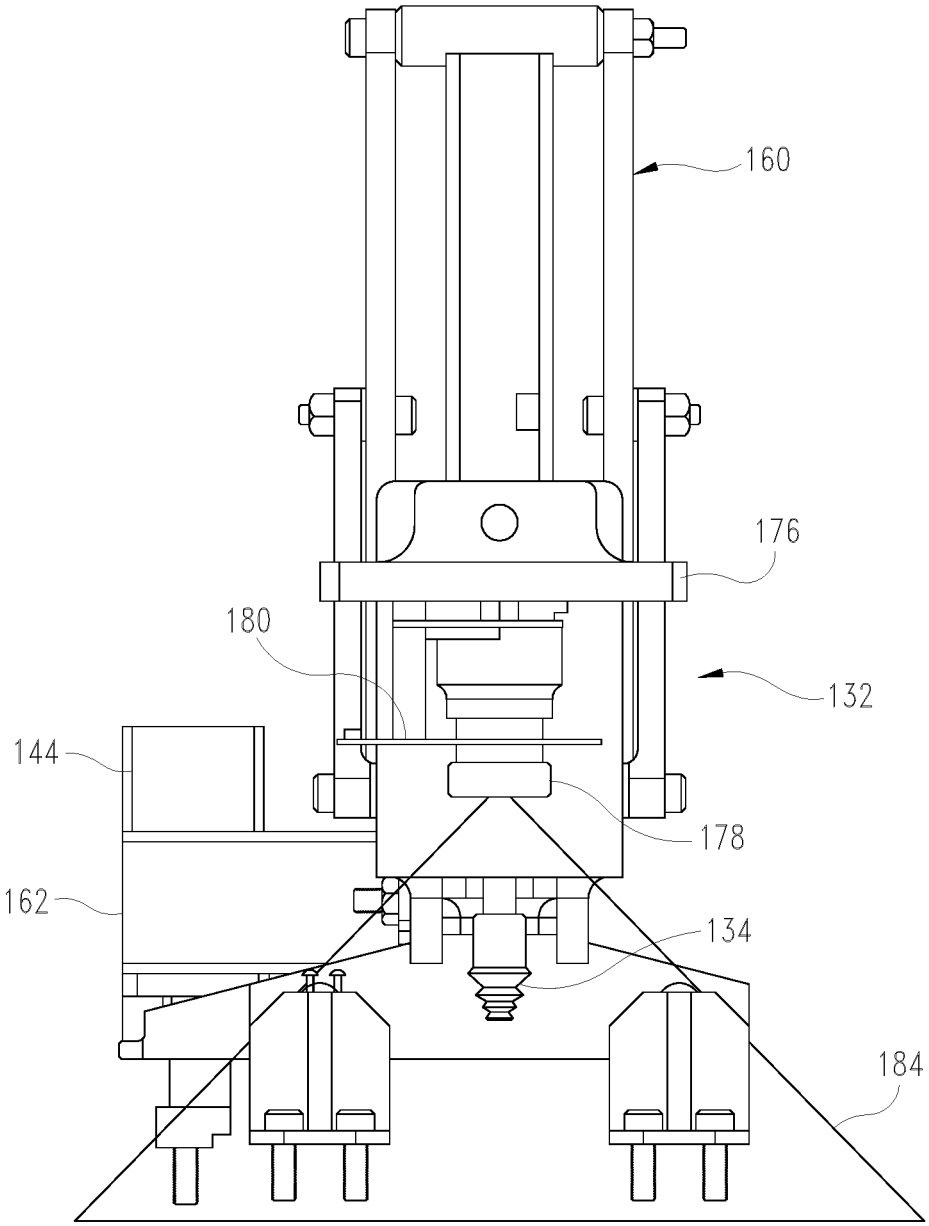

FIG. 5 shows a top down view of the carousel cover 136, the stages 140, 160, camera mount 176, and a system printed circuit board 202 which can be mounted thereon that provides a computer controller 250 that can be programmed to operate the device 100. FIG. 6 is also a top down view with the carousel cover 136 removed to allow for better viewing of the system printed circuit board 202 and stages 140, 160. The circle of cone 184 shows the area of view of the camera 178. FIG. 7 is a side perspective view of FIG. 6. FIG. 8 is a further side view of the stages 140, 160, vision system 132, and vacuum nozzle 134. FIG. 8 also shows the cone 184 indicating the camera view area. FIG. 9 is an end view of FIG. 8.

Figure 10A:
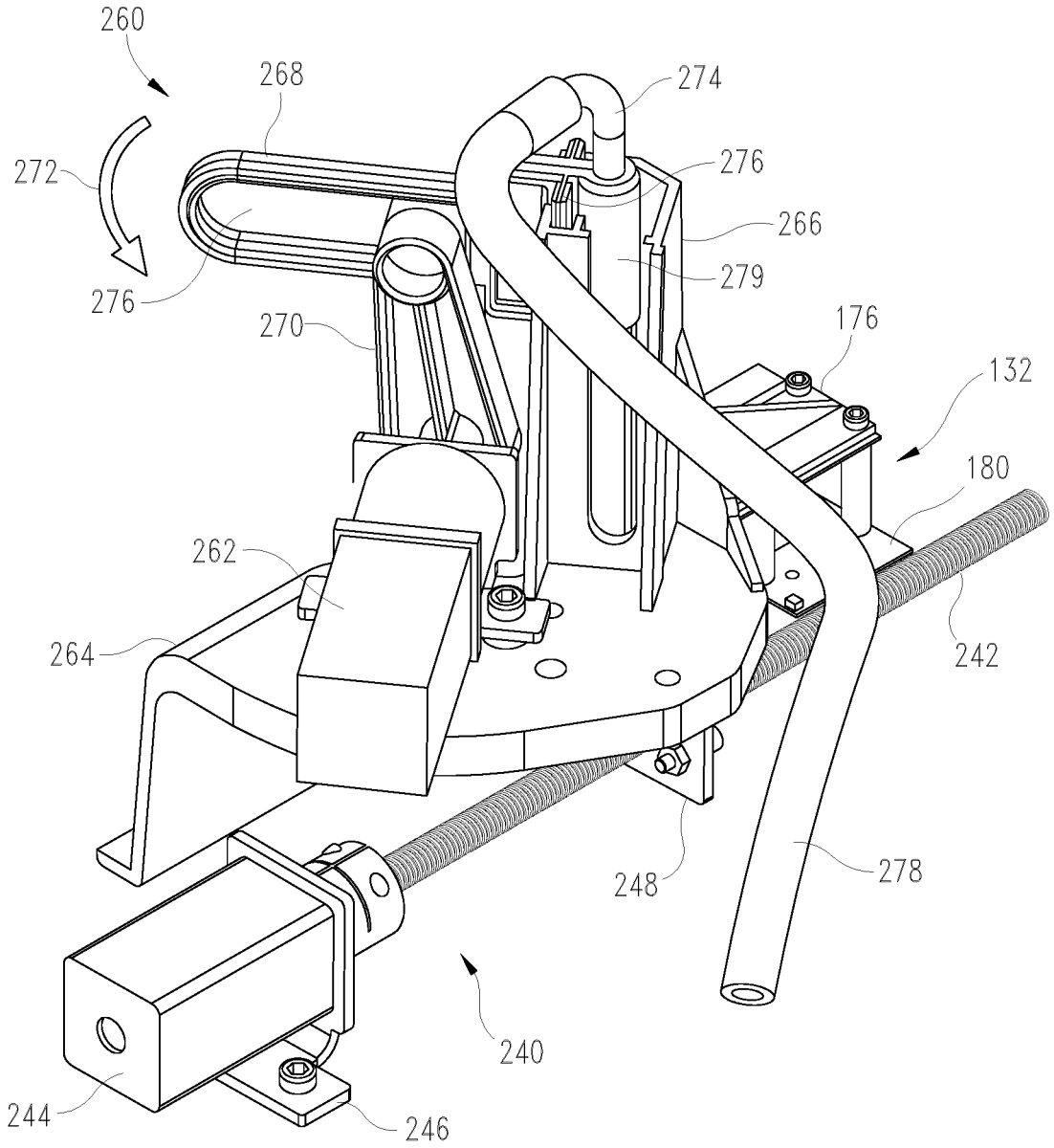
FIGS. 10A-10B are views of another embodiment Z stage mechanism and radial stage mechanism mountable to a carousel of the dispensing apparatus of the present disclosure.
Figure 10B:
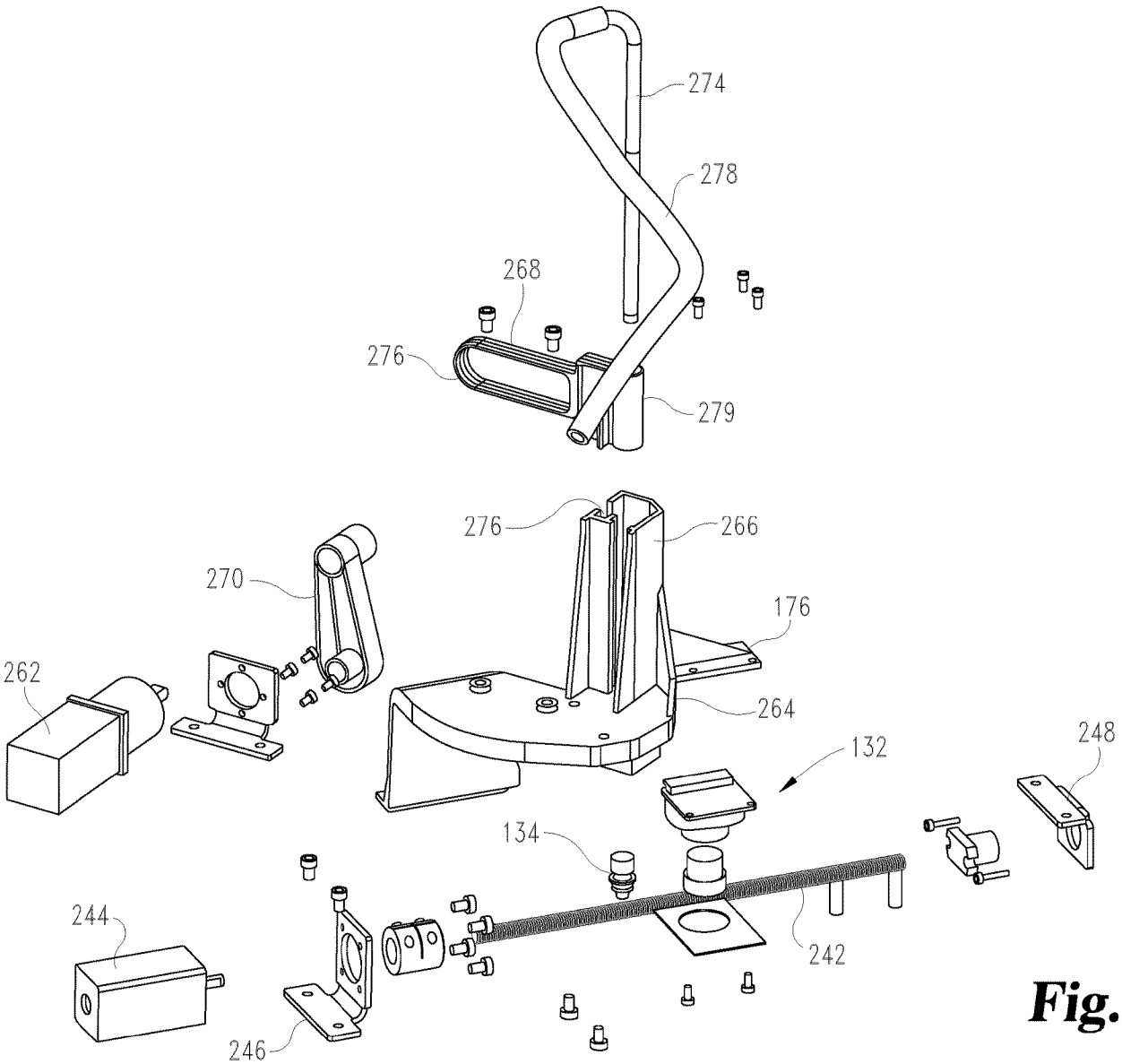

FIGS. 10A and 10B show another embodiment for the radial stage and Z stage. In this embodiment, the radial stage 240 includes a guide rod 242 that is threaded and engaged at one end to a radial stage motor 244. Guide rod 242 and radial stage motor 244 can be mounted to top 138 of carousel 128 with first bracket 246 via a threaded nut, such as a plastic nut. Z stage 260 is coupled to guide rod 242 with second bracket 248 for movement radially along carousel 128 via operation of guide rod 242.

Z stage 260 includes a carriage 264 to which a Z stage motor 262 and a vertical column 266 are mounted. Vacuum nozzle 134 is movable via movement of a yoke 268, which is coupled to a crank 270 driven by Z stage motor 262. Rotation of crank 270 as indicated by arrow 272 moves crank 270 along the slot 276 of yoke 268, which drives the yoke 268 downwardly along vertical column 266. Vacuum nozzle 134 is connected via the vacuum tube 274 attached to an arm 279 of yoke 268. Vertical column 266 guides the movement of vacuum nozzle 134 downwardly into the aligned bin 200.

The device 100 includes a vacuum pump (not shown) connected to vacuum nozzle 134 via tube 274 and flexible tubing 278 to create the vacuum pressure used to retrieve pills. A pressure sensor (not shown) can monitor the pressure in the vacuum tubing 278 to determine when the vacuum nozzle 134 is blocked, such as when the vacuum nozzle 134 has sealed against a pill. The pressure sensor can be connected to the vacuum nozzle 134 through a tee and a three-way pressure relief valve that disconnects the vacuum pump from vacuum nozzle 134 and allows air to flow to quickly relieve the pressure and drop the pill into the dispensing cup 114.

Other embodiments contemplate other mechanisms for the radial stage and/or Z stage. For example, a linear slide and rack mechanism, a rack and pinion mechanism, a four-bar mechanism, a lead screw mechanism, a lead screw and guide rod mechanism, a rotating cam/translating follower mechanism, a crank and slide mechanism, and combinations of these, may be used for one or both the radial stage and Z stage.

Figure 11A:
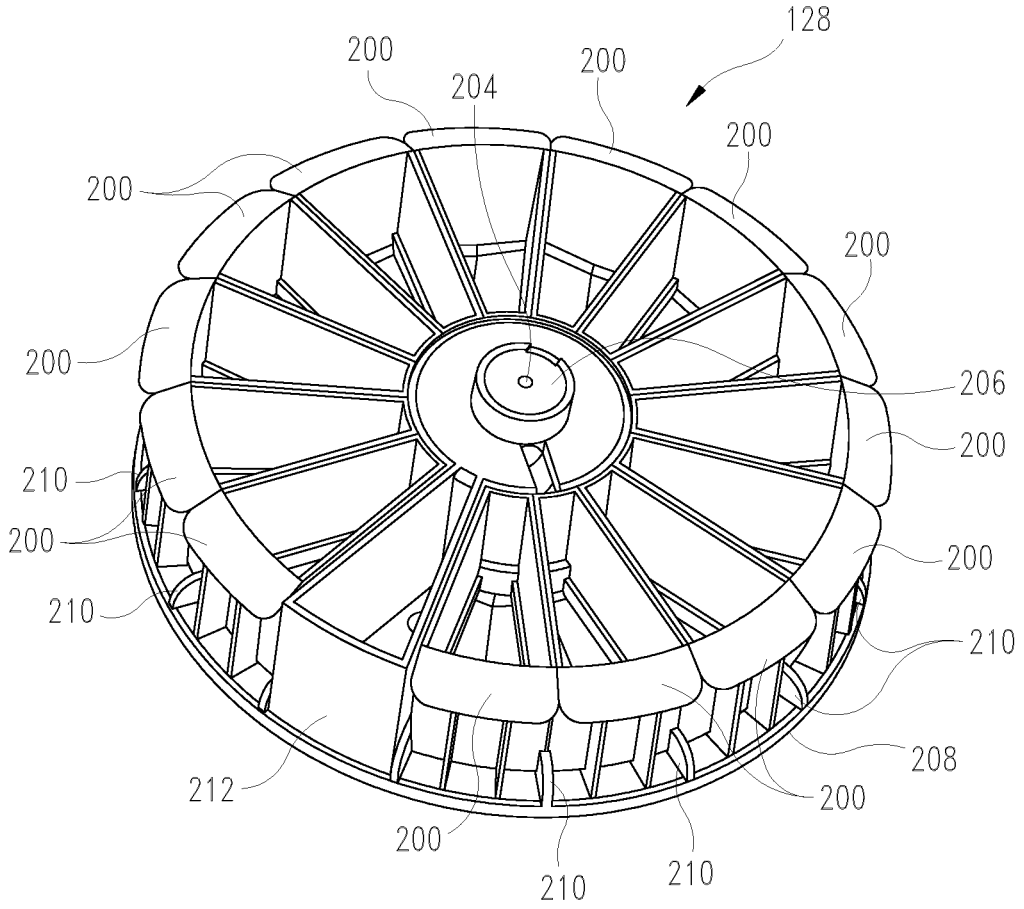
FIG. 11A is a perspective view of a plurality of bins of the carousel of the dispensing apparatus according to the present disclosure.

FIG. 11A is a top view of the carousel 128 with the cover 130 removed. In the illustrated embodiment, the carousel 128 includes fourteen bins 200 that are each generally wedge-shaped like pie slices, each capable of containing a plurality of pills. The carousel 128 rotates about center shaft/axle 204 under the power of a rotary motor (not shown). An absolute encoder disc 206 is in the center of the carousel 128 and is used in conjunction with an absolute rotary position sensor mounted on the system PC board 202 to monitor the absolute rotational position of the carousel 128. The absolute rotary position sensor can translate the angular position or motion of the shaft/axle 204 that rotates the carousel into an output signal, which always allows the device 100 to know the position of the carousel 128, and no home reference location is required to reference the location of carousel 128.

The carousel 128 includes a base 208 upon which the bins 200 sit. The base 208 has a plurality of bin guides 210 that act as dividers between adjacent bins 200 and guide the bins 200 into the proper position. The carousel 128 also includes a blank bin location 212, which as noted above, sits under the camera 178/vacuum nozzle 134 when the carousel 128 is in the home/idle position. As a result, no pills are under the camera 178 or the opening 186 in the carousel cover 136, which prevents any pills from jumping bins or wandering loose in the system in the event the device 100 is tipped or falls over.

Figure 11B:
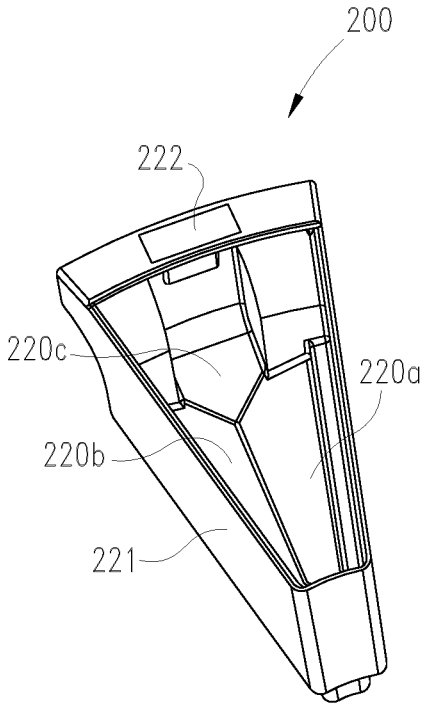
FIGS. 11B-11D are various views of one embodiment of a bin of the carousel of the dispensing apparatus of the present disclosure.
Figure 11C:
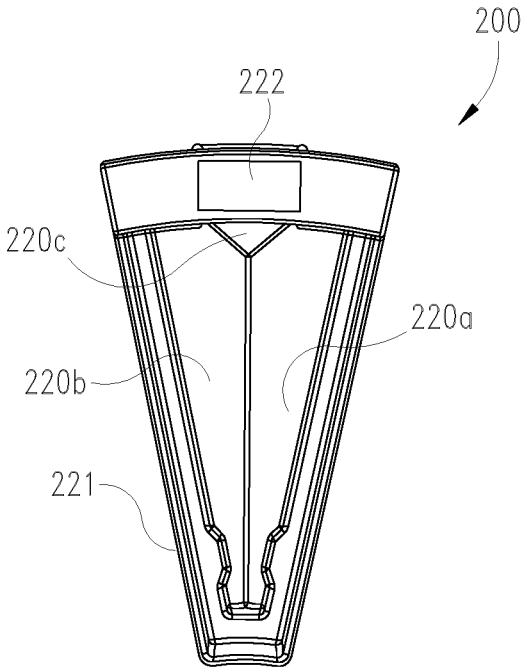
Figure 11D:
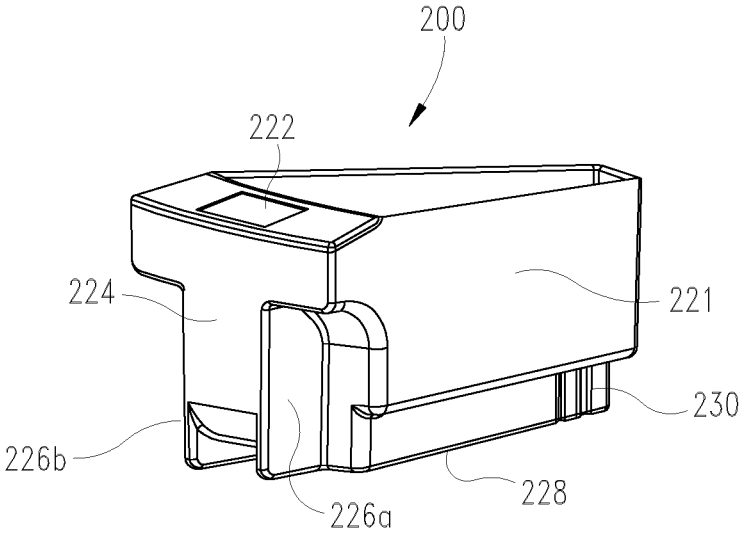

FIGS. 11B-11D show multiple views of an individual bin 200. The bin 200 includes a tapered bottom 220 with sloped segments 220*a*, 220*b*, 220*c* that slope downwardly from the outer walls 221 of the bin 200 toward its center. The pills will then congregate away from edge of the bin 200, where the vacuum nozzle 134 has a more difficult time selecting a pill. The bin 200 may also include a label location 222, where a label can be affixed. The label can include a bin number that is presented as both text and bar code. The device 100 can use the camera 178 to read the bar code to ensure that the correct bin 200 has been returned to the correct carousel location. The text label will also assist the user with loading pills into the proper bin 200. The label can also include information about the contents of the bin 200, which could be prepared by a pharmacy or prescription fulfillment service, for example. The label can thus be used to verify contents of the bin 200 with the information entered into the device 100 about the proper pill that should be in the bin 200.

The outside end 224 of the bins 200 includes a shape that allows the bin 200 to be grasped with two fingers for removal and insertion (bin finger-holds 226a, 226b). The part of the bin 200 closest to the center of the carousel 128, and at the bottom 228, includes a retention feature 230. The nose of the retention feature 230 fits into corresponding structures on the bottom of the carousel base 208 at each bin position to hold the bins 200 in place, but still allow for their removal as needed.

In operation, when the device 100 needs to deliver a pill to the dispensing cup 114, the carousel 128 rotates to the bin location so that the proper bin 200 with the pills to be dispensed is located under the camera 178. The carousel movement exposes the medication to the radial and Z stages 140, 160 or 240, 260. The radial stage 140, 240 then moves from the inner position (center of the carousel 128) to place the camera 178 over the pills within the bin 200. The device 100 records an image from the camera 178 and analyzes the image to locate the center point of pills within the image and selects a pill to retrieve (as determined by the pill selection algorithm described below). The device 100 then moves the radial and Z stages to place the vacuum nozzle 134 directly over the selected pill. The device 100 turns on the vacuum pump, and the Z stage 160, 260 moves down into the bin 200, so the vacuum nozzle 134 can pick up a selected pill. When vacuum pressure reaches a predetermined differential pressure from ambient the device 100 determines a pill is present. When a pill is picked up the Z stage 160, 260 moves upward. The radial stage 140, 240 then moves to its outermost position to access the dispensing cup 114 location, the vacuum pump is turned off, the pressure relieve valve is actuated, and the pill drops into the dispensing cup 114. The process is repeated for dispensing multiple pills. The dispensing cup 114 is located outside the diameter of the bins 200 to avoid accidentally dropping the pill into another bin, for example in the case of a vacuum failure. In case of a vacuum failure, the pill would simply fall back into the bin 200 from which it came.

The operation of vision system 132 for optical pill detection will now be described. The pill detection employs a computer-operated vision system 132 that segments an image of pills in a bin 200 into individual pills, and further selects the locations of the "best" pills for the bin-picking system, using vacuum nozzle 134 and the radial stage 140, 240 and Z stage 160, 260 to target for pickup.

Sample output from the vision system 132 is shown in FIG. 12, where the circles indicate locations the vision system 132 has identified as a pill, and stars indicate the pills the optical system recommends as the three "best" for the vacuum nozzle 134 to attempt to pick up. The circles and stars in FIG. 12 may be represented by colored dots in implementation. The pill positions, indicated in this picture by the circles and stars, come with physical coordinates within the bin 200, to be passed to the control system for the stage motors 144, 244, 162, 262 for use in positioning the vacuum nozzle 134.

The vision system 132 may use edge detection to find the bounding contours around pills, take the interiors of these contours as regions representing individual pills, locate their geometric centers, and use areas to select which of these regions may represent the easiest pills to pick up.

The vision system 132, using statistical analysis, can account for the great variety of shapes, colors, patterns, markings, and even topologies used for pharmaceuticals. The vision system 132 is designed to work as well as possible on average, rather than in every case, to deal with the great variety of pill shapes. The vision system 132 considers not only the shape of the pills but also the fact that pills can have writing, texture, and markings that cause additional edges to be detected which are not associated with pill boundaries. The vision system 132 also adjusts for variation in color and lighting that can cause detected boundaries between pills to be incomplete to prevent multiple pills from being grouped together as one.

The vision system 132 has been designed to strike a good balance between these issues, giving solid pill detection for the greatest variety of pill types. The accuracy of pill detection is measured by visually inspecting the camera output in the form of images like the one in FIG. 12, and assign scores according to the criteria in Table 1.

Table 1

| Points | Criteria |
|---|---|
| | All stars are located inside the defined pill edge, with some margin to pill edge |
| 0.75 | All stars inside pill edge, but one or more offset from the center of the pill |
| 0.5 | All stars inside pill, but one or more with no margin to edge |
| 0.25 | One or more stars falling off the edge of a pill |
| | No star or stars not on a pill |

The computer-controlled vision system 132 can be understood as including of three major steps: 1) image preprocessing, including cropping, background subtraction, and filtering; 2) location of pills, using edge detection, dilation, inversion, and blob detection; 3) selection of pills according to blob size and shape. The following provides a more detailed descriptions of the individual components of the steps in greater detail.

Un-Distorting the Image

Image pre-processing can be used where the image is geometrically transformed to remove the distortion ("fisheye effect") resulting from the use of a wide-angle camera too close to the subject. This straightens lines that appear bent near the edge of the image to restore an approximate far-field perspective.

Masking and Cropping

A significant portion of the image near the border is not needed because it represents area outside of the physical bin. An initial step therefore is to use a template bin image to mask out this superfluous area, zeroing out all pixels outside the bin. This is done using a template in the shape of an empty bin at a 0% fill. While this can sometimes remove a portion of a viable pill near the edge of the bin, it focuses the detection on the most valid portion of the bin. Indeed, what is zeroed out typically lies within the zone in the bin where the vacuum nozzle 134 may have greater difficulty in retrieving a pill. Since the bin 200 is tapered, pills are prevented from staying in this area as the number of pills decreases, which further reduces the need to select pills from this region.

After masking, a significant portion of the image near the border is entirely blacked out. To minimize processing time, the image is cropped to the smallest possible rectangle that contains all the valid targets.

Background Subtraction

Next, a typical image will still contain significant "background," including regions where the walls and floor of the bin 200 are still visible. These are potential sources of additional non-useful edges which can interfere with the rest of the pill detection process, and these regions can be cut away or ignored. Two steps effectively remove most of the background from of the picture, both carried out by comparing the image with a template image of the empty bin.

The first step is a color-wise subtraction, pixel by pixel, of the empty bin picture from the image. In regions where there are no pills, and where the empty bin is thus still visible, the actual image and the template image will be nearly the same and such pixels are thus effectively zeroed out. On the other hand, since the interior of the bin is black, little is subtracted from image regions where a pill is present (pills are essentially never this dark).

The second step relies on comparing the color spectrum histogram of the current image against the corresponding histogram of the template empty bin. The difference of these two histograms gives a picture of the spectrum corresponding to the actual pills in the image. Enhancing the intensity of the image in parts of the corresponding parts of the color spectrum thus emphasizes colors and intensities that are not prevalent in an empty bin—identifying them as regions where pills are likely located.

Finally, these results are used to create a binary image, and this is used as a mask to black out everything not identified as 'pill area'. This further reduces the area of interest to include only the regions where something desired is in the bin. The whole process can be viewed as an initial "pill detection", but at the level of detecting the entire collection of pills in the bin, without separating into individual pills.

It is worth noting that effective background subtraction relies on having a good picture of the empty bin, and may need periodic recalibration, by simply taking a picture of a bin with no pills from time to time for an updated reference.

Canny Edge Detection

This is an algorithm for fast edge detection. It uses a combination of: 1) convolutional filters, which remove noise by blurring and locate directional changes in intensity ("edges"); 2) non-maximal suppression, which takes the strongest detected edges and thins these edges out to a single pixel width; and 3) hysteresis thresholding, which keeps edges whose intensities are above a specified "upper" threshold, as well those with intensities above a specified "lower" threshold provided these are connected to edges above the upper threshold. This helps ensure continuation of edges that are weaker in some areas.

Achieving maximal success with canny edge detection across the wide variety of pill types requires some experimentation to correctly establish the upper and lower thresholds. Inaccurate thresholds can generate too many spurious edges being detected, leading to a noisy picture, or good edges may not completely encircle pills.

Edge Dilation

Even when canny edge detection performs optimally, the edges detected may not be closed contours. For example, in FIG. 13, although the edges are quite good from the perspective of a human viewing the picture, there are tiny gaps in many of the edges, which can make it difficult for the computer to detect the closed contours naturally seen.

Figure 14:
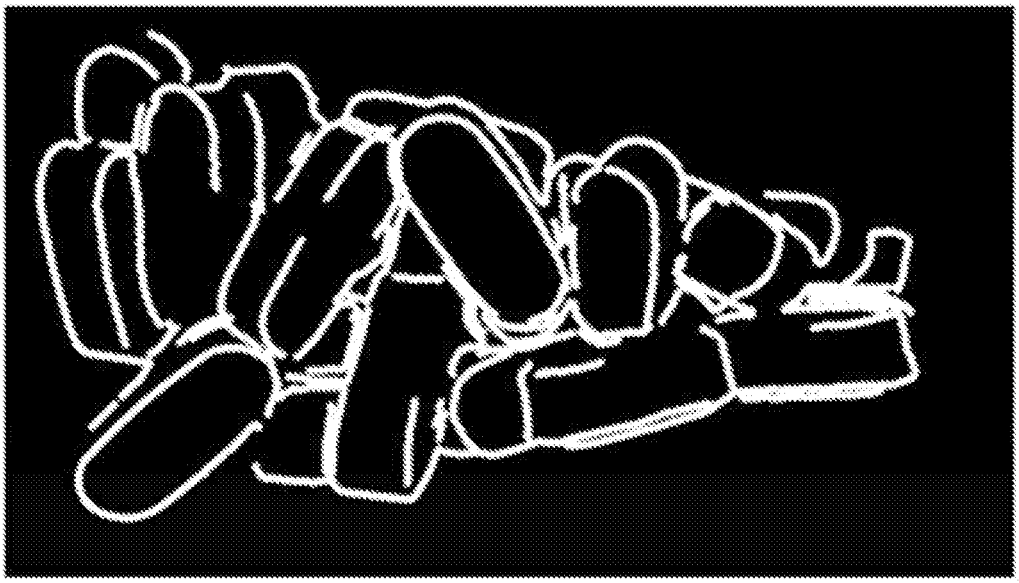

The next step is to thicken the edges. This process is completed by finding the existing contours in the image, and overdrawing them with a thicker line, transforming the image from FIG. 13 to the one in FIG. 14.

Inversion

Figure 15:
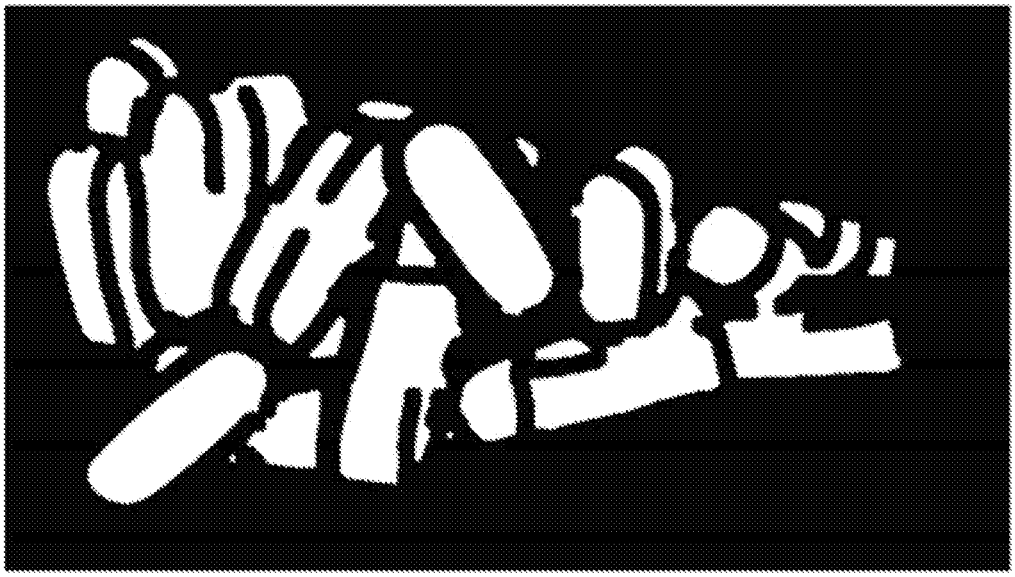

Next, the edge image color profile of the binary image is inverted: black becomes white and white becomes black. This is masked to the official 'pill area' as defined during the subtraction analysis to keep the background black. The picture is run through erosion and dilation to break apart additional pill clumps and to leave the center of mass for pills in the pill area, as shown in FIG. 15.

Blob Detection

At this point, a conventional blob detection algorithm is used, such as one available from OpenCV. Since the image is binary, this will detect connected regions that are either white or black. The algorithm returns a list of "blob objects," each of which comes with geometric information about the detected blob including the bounding contour, center point, and total area.

To eliminate some misshapen blobs, which may not represent an actual pill but a group of pills, a parameter in the algorithm is used to discard blobs that are not close enough to convex. The convexity of a region is the ratio of its area to its convex hull—smallest convex area containing that region. Any blob with convexity below one half is discarded.

Figure 16:
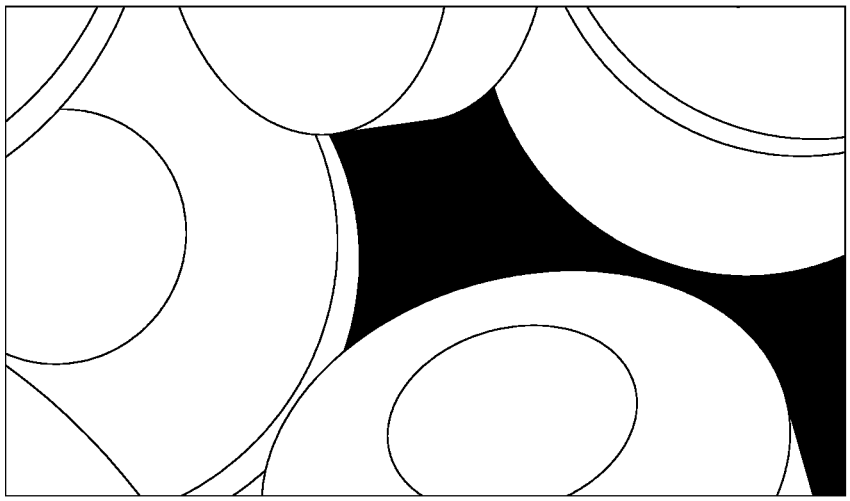

Sometimes a blob is detected that is a gap between pills. For example, naive blob detection is likely to find a "blob" at the location of the large black gap between pills in the center of FIG. 16. This occurs because there is a well-defined contour all the way around this gap. To eliminate such blobs, a check is done to determine whether the intensity at the blob's center in the original image is below a certain threshold, and if so it is discarded accordingly.

Blob Size Statistics

One approach to pill selection is simply to take the largest blobs returned by the blob detector and set their center points to be the recommended locations to pick up a pill, provided those points do not fall within the "dead zone" defined near the bin's outer boundary. In many cases, this strategy is quite effective. Ideally, there is a near one-to-one correspondence between physical pills in view and blobs detected, in which case the largest blobs tend to represent pills that are unobstructed by other pills.

Figure 17:
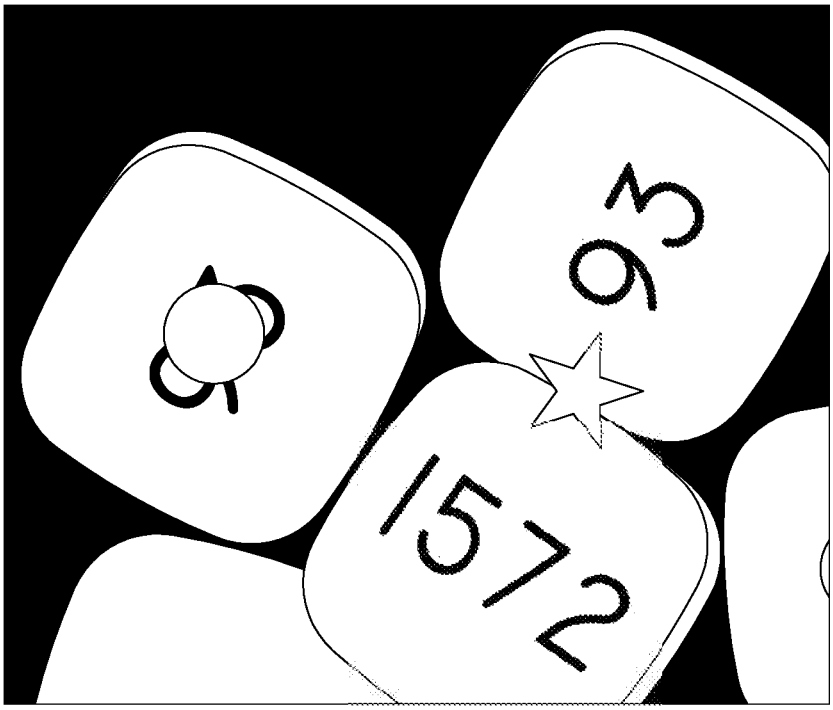

However, problems can arise from the assumption that blobs represent physical pills. The most significant and frequent problem is that for two or more overlapping pills with similar illumination, no significant edge might be detected between them. This leads to two pills being "conjoined" in binary image where the blob detection is performed, and in this case, the recommended "pill center" often ends up being directly between two pills. This effect is clearly exemplified in FIG. 17, where two pills were identified as one collective blob, as indicated by the star.

This problem can be ameliorated, and significant improvements in overall performance achieved, by considering the statistics of blob sizes and removing outliers that might represent conjoined pills before selecting the "best" ones. After performing blob detection, the approach is to now sort the blobs by size and discard any that are more than a certain threshold larger than the median blob size, or smaller than a certain threshold than the median blob size. The largest blobs that remain are selected.

Improved Edge/Boundary Detection

An important step in the computer vision system is accurate detection of the boundaries between pills. The key step in the current system toward detecting these boundaries is the Canny edge detection algorithm. This produces nice looking edge pictures, and is very fast; however, the edges do not always correspond only to the natural boundaries between pills.

In fact, there is an important difference between edge detection and boundary detection, not every edge is a pill boundary: "edges" are curves along which there is a high intensity gradient in the orthogonal direction, and these occur not just between pills but also on the surfaces of pills, and elsewhere, due to many factors including textures, writing, shadows, illumination changes resulting from curvature of pill surfaces and more. On the other hand, "boundaries" refer to curves that separate pixels belonging to one object from pixels belonging to another.

Figure 18:
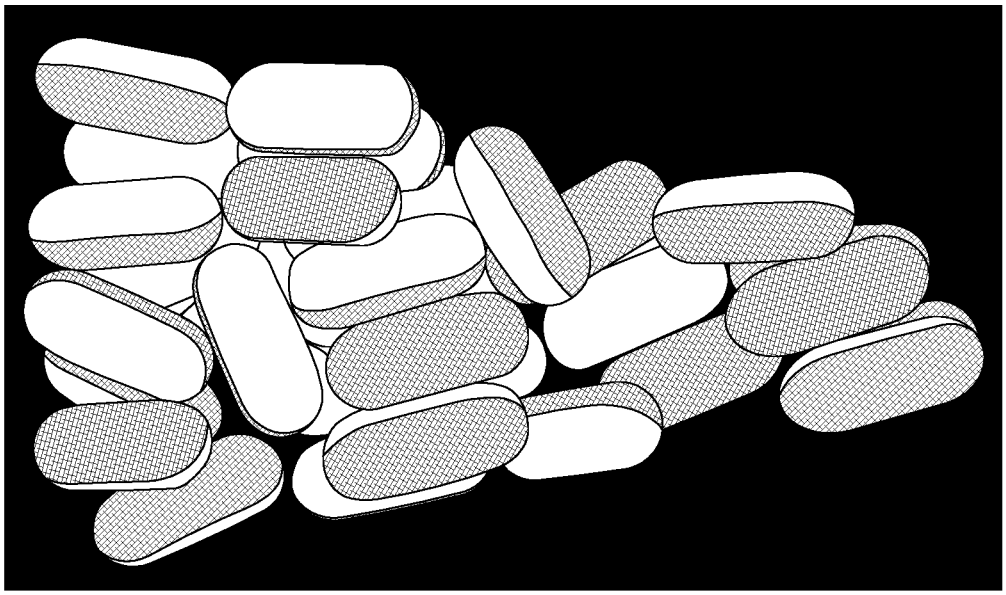
Figure 19:
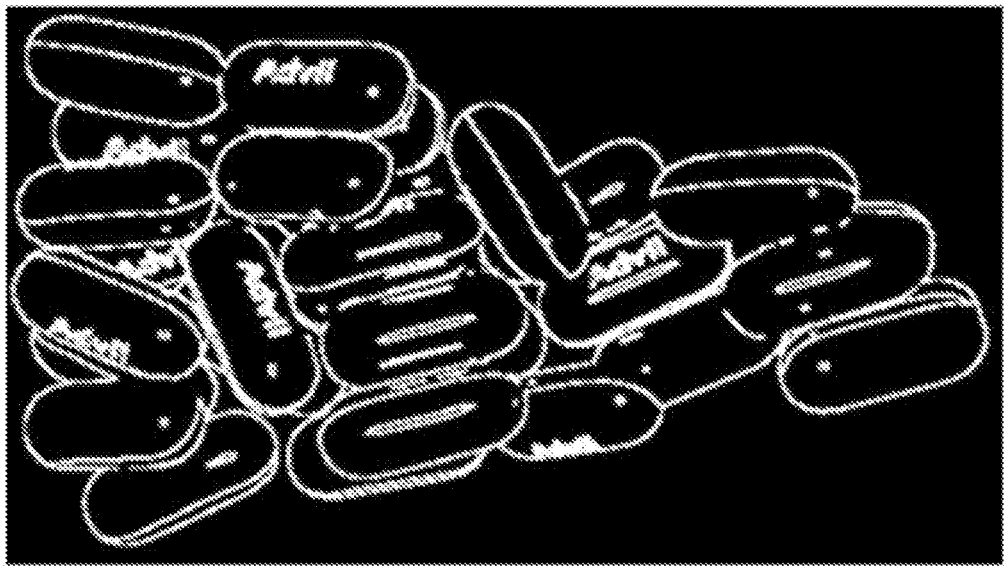

Human drawn boundaries of pills typically look like the curves drawn around the pills in FIG. 18. An ideal boundary detection system would be able to find these same boundaries, and such a perfect boundary detection would lead to near perfect pill selection as well. On the other hand, an edge detector would be expected to also pick up the words on the pill, the line separating the colors between pill halves, and the high-intensity spots coming from glare of the lighting. What might be seen by the algorithm is shown in FIG. 19. The vision system 132 is capable of locating the pills, in three dimensional space, using camera 178 without the use of additional cameras.

The following describes further aspects of the vision processing attributes of the vision system 132. Once pills have been detected in the image and the primary pill selected, the pill detection software provides instructions to the motion control software to position the vacuum nozzle 134 over the pill through a combination of radial stage movement (rho) and carousel motor movement (theta). The pill detection software also provides an estimate of the fill level (Z height), allowing the vacuum nozzle 134 to be lowered quickly at first and then slowly as it approaches the pills.

The process of generating three-dimensional positioning information from a single camera image according to the present disclosure begins with a determination of the fill level. The fill level determination takes advantage of the optical properties of a wide-angle camera that makes the entirety of the bin vertical sidewall visible in the image. Use of a black bin maximizes the contrast between the most common pill colors and the bin, and subtraction of an image from the empty bin image as previously described results in a new image that includes only pills. The outline of this pill image is then used to determine the fill height by comparing the extents of the pill image against the expected extents for fill levels ranging between 0-100%, as shown for bins 200 in FIGS. 20A-20E.

Figure 20A:
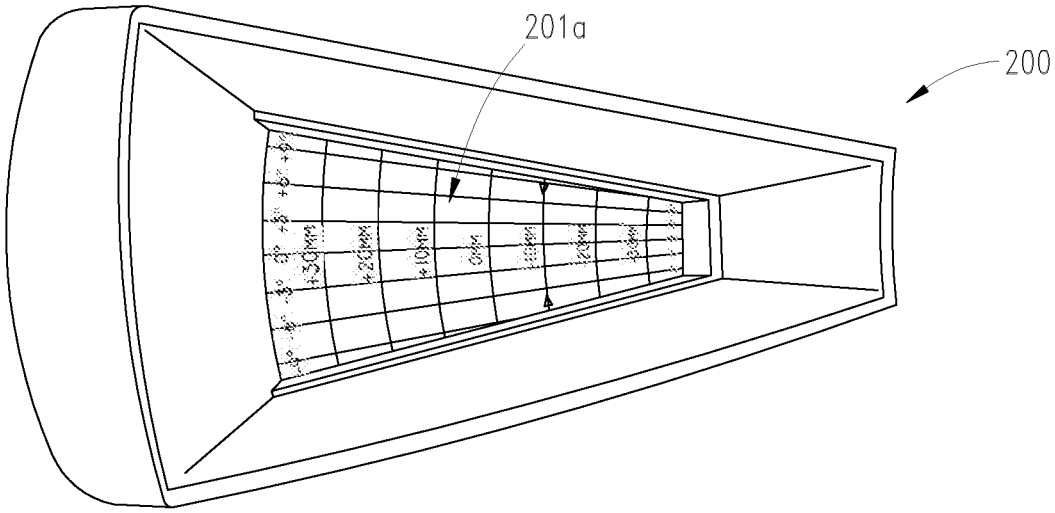
FIGS. 20A-20E show various calibration targets for a bin of the carousel of the present disclosure.
Figure 20B:
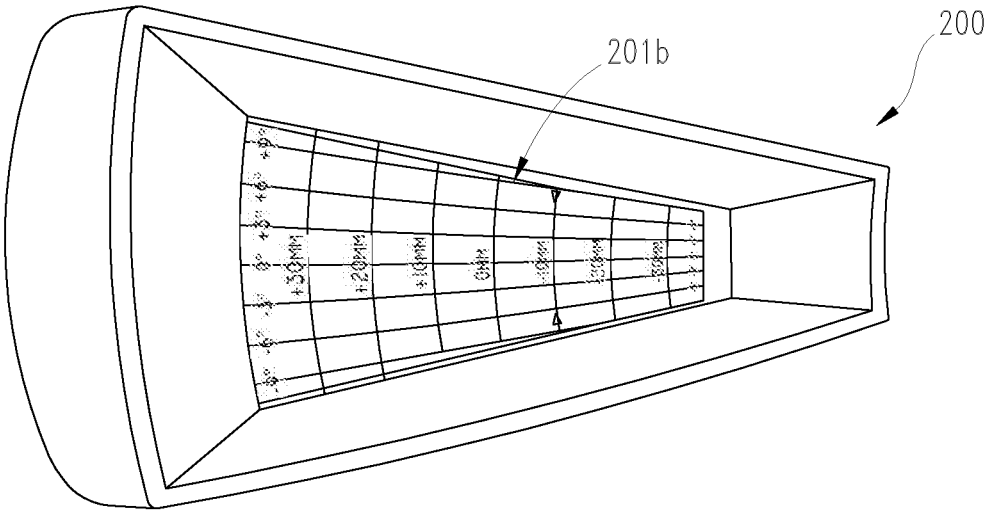
Figure 20C:
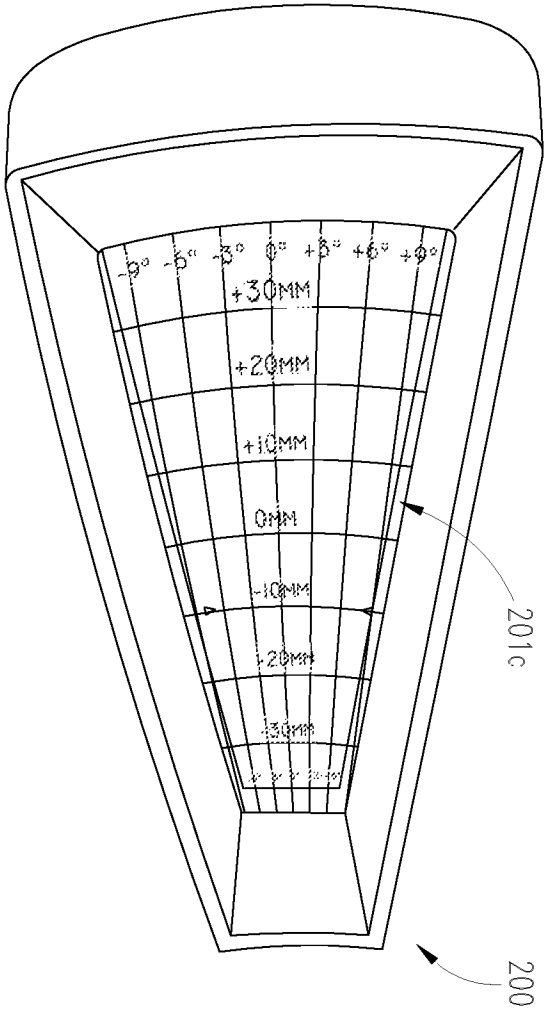
Figure 20D:
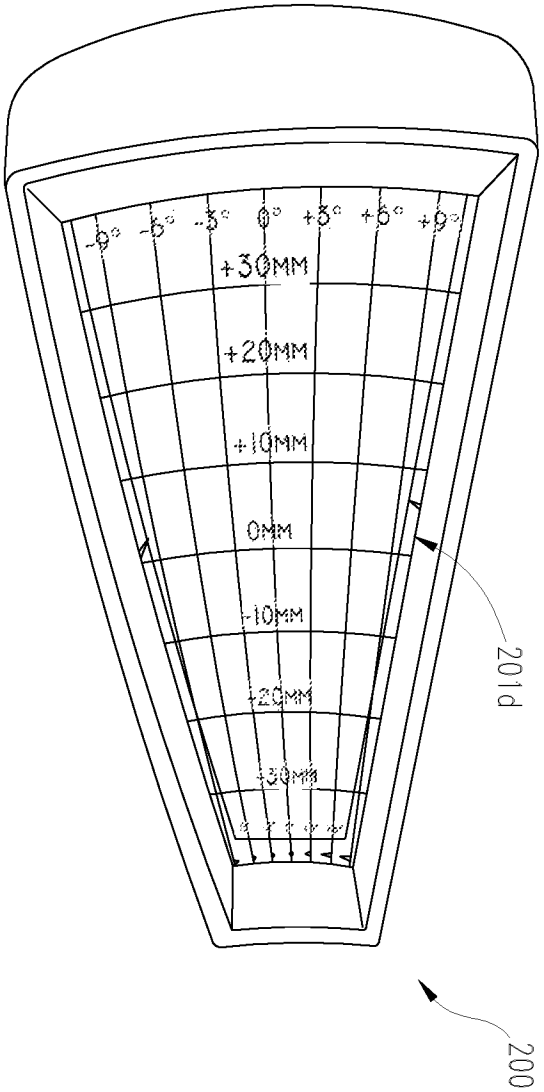
Figure 20E:
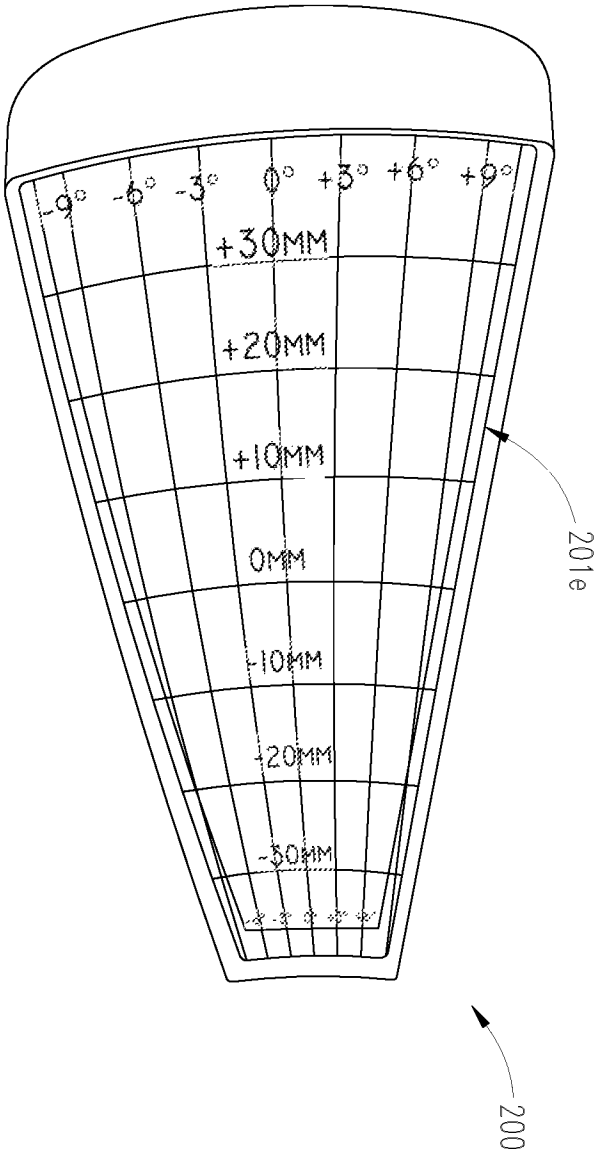

In FIG. 20A, bin 200 includes a 0% calibration target as shown by grid 201*a*. In FIG. 20B, bin 200 includes a 25% calibration target as shown by grid 201*b*. In FIG. 20C, bin 200 includes a 50% calibration target as shown by grid 201*c*. In FIG. 20D, bin 200 includes a 75% calibration target as shown by grid 201*d*. In FIG. 20E, bin 200 includes a 100% calibration target as shown by grid 201*e*.

Once the fill height is determined, the positioning of vacuum nozzle 132 becomes a 2-dimensional transformation between the image coordinate system, in pixel (X, Y), and the motion control coordinate system (rho, theta). The image distortion created by a wide-angle lens complicates this coordinate system transformation due to the curvature of straight lines. In one embodiment, therefore, the raw camera image is first undistorted through a transformation to correct for lens distortion. With physically straight lines appearing straight in the corrected image, a geometric transformation can be used.

In one embodiment, the geometric transformation requires only three parameters to be known: 1) the convergent point of the image in pixel (X, Y) and (rho, theta) coordinates, where the convergent point is defined as a (rho, theta) coordinate that appears at the same pixel (X, Y) coordinate for all Z-heights; 2) the millimeter per pixel (mm/pixel) scaling factor of the image at the current Z-height; and 3) the rotation of the image, if any.

While the convergent point is nominally at the center of the image and at the center of the bin, in practice it may be located off-center. Similarly, while the rotation is nominally zero, the coordinate system transformation supports non-zero image rotation. The mm/pixel scaling factor for various fill levels (Z-height) is determined by placing calibration targets in the bins for a range of fill levels (e.g. 0%, 25%, 50%, 75% and 100%) and determining the pixel (X, Y) coordinates for specific (rho, theta) coordinates as shown in FIGS. 20A-20E. The mm/pixel scaling factor is determined directly at the calibration fill levels and then extended to other fill levels through curve fitting and calculation.

The calibration process prior to geometric transformation involves several steps. First, the calibration process includes performing a lens distortion correction (e.g. using the camera calibration procedure available in Open CV a commercially available open source vision software system) and loading the camera correction matrix. Next, the calibration process includes recording calibration images across a range of fill heights (e.g. 0%, 25%, 50%, 75%, 100%) and applying camera calibration.

Next, the calibration process includes determining the mm/pixel factor for each Z-height and fitting an equation to calculate the mm/pixel factor for any arbitrary Z-height. The calibration process next includes identifying the convergent point location in both pixel (X, Y) and position (rho, theta). The calibration process next includes determining the rotation of the image about the convergent point. The calibration process then includes creating an array of calibration points at each of the calibration fill heights and overlaying on top of the image to assess the accuracy of the calibration.

The calibration process next includes generating templates for bin masking utilizing the calibration parameters to create black-and-white images of the expected bin extents at each fill level. The calibration process then includes determining the slope of the line defining the upper bin wall and creating an array of the upper left corner location of each template for use in fill height determination.

The geometric transformation process also includes a number for steps. First, the geometric transformation process includes determining the fill height from the pill image by evaluating if the top pixel in the pill image is above or below the line defining the upper bin wall for each fill height in the calibration array. The geometric transformation process then includes rotating the image around the convergent point in the opposite direction as the rotation determined during calibration. The geometric transformation process then includes calculating the distance in pixels from the convergent point in both the X and Y dimension.

The geometric transformation process then includes using the mm/pixel factor for the determined Z-height to transform pixel (X, Y) to distance from the convergence point in millimeters. The geometric transformation process then includes using the known geometry of the carousel to convert the (X, Y) distance in millimeters into (rho, theta) movements.

The geometric transformation process has two drawbacks that hinder its practical application that addressed by the present disclosure. First, lens correction algorithms, while widely known, are computationally expensive resulting in slow pill picking on low cost microprocessors. Second, lens correction may not be 100% effective at making straight lines straight in the image, and any remaining curvature will result in positioning errors.

Figure 21A:
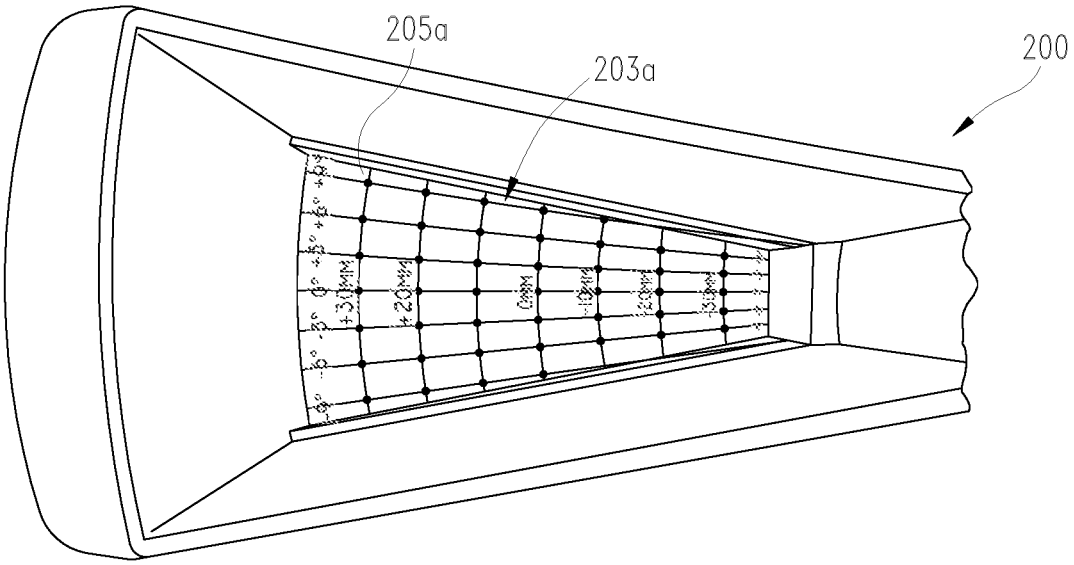
FIGS. 21A-21B show various calibration targets overlaid with calculated corner intersections for a bin of the carousel of the present disclosure.
Figure 21B:
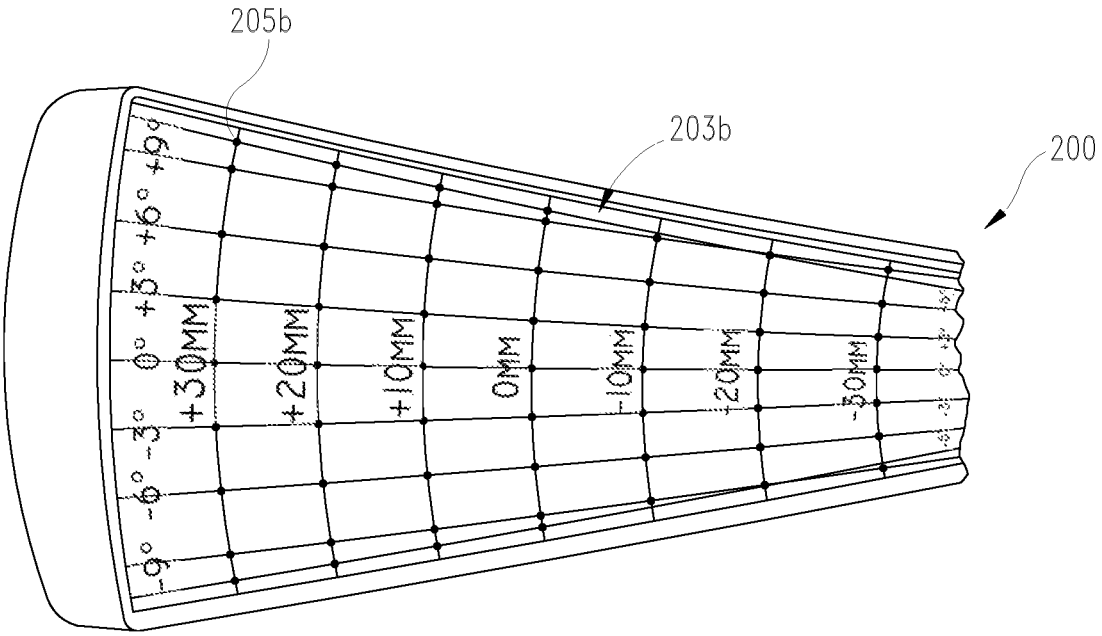
Figure 22:
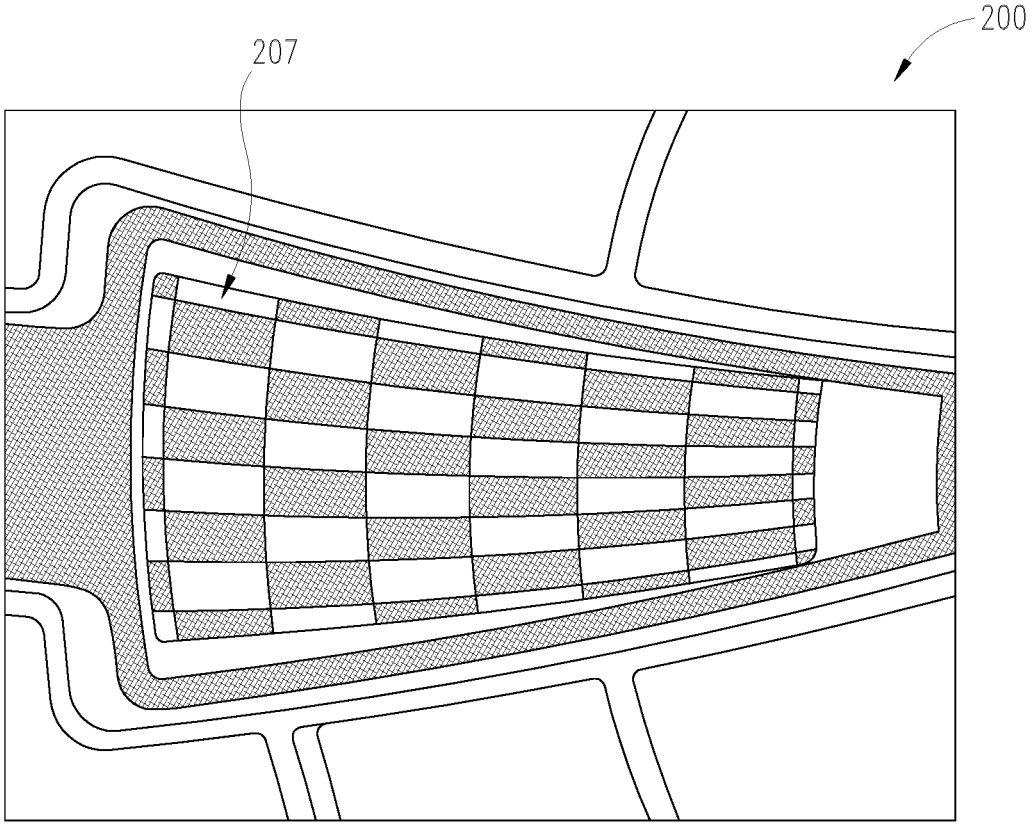
FIG. 22 shows a calibration target for automatic corner detection for a bin of the carousel of the present disclosure.
Figure 23A:
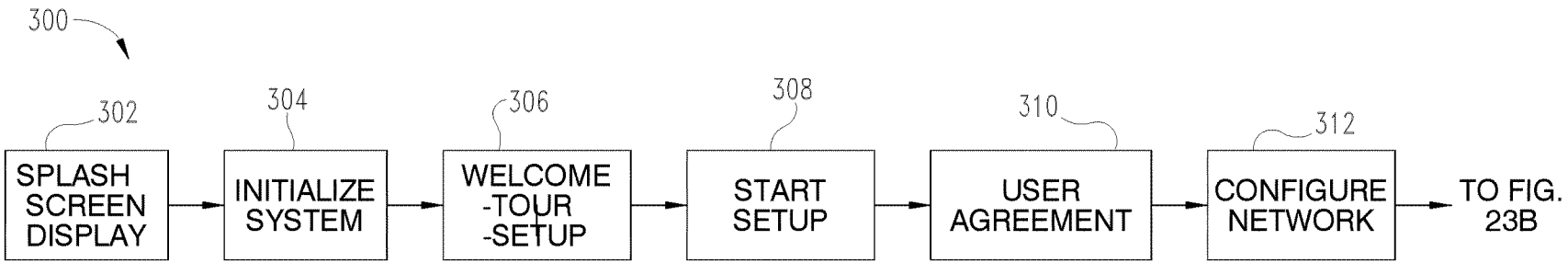
FIGS. 23A-23D is a flow diagram for example steps of a setup wizard for the dispensing apparatus of the present disclosure.
Figure 23B:
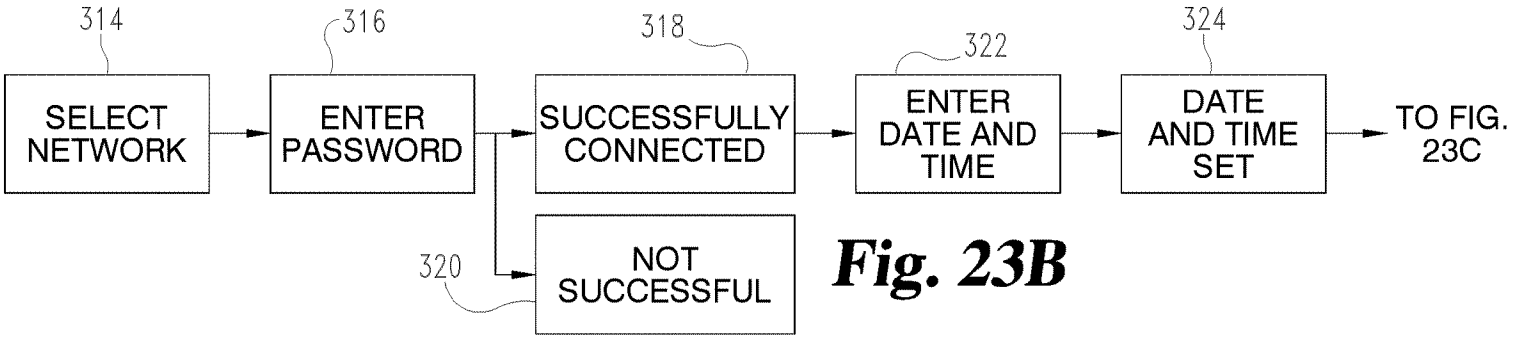
Figure 23C:
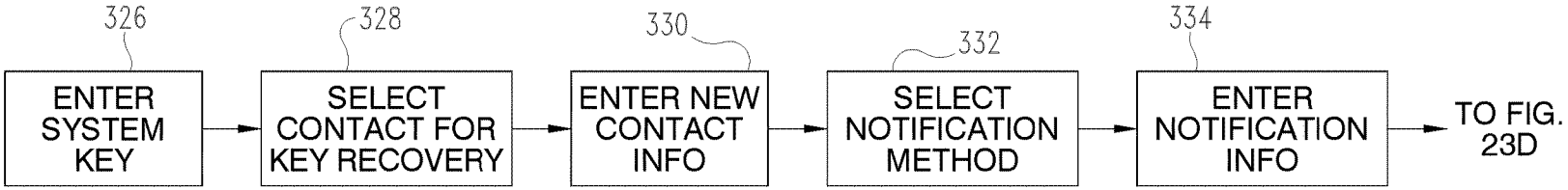
Figure 23D:
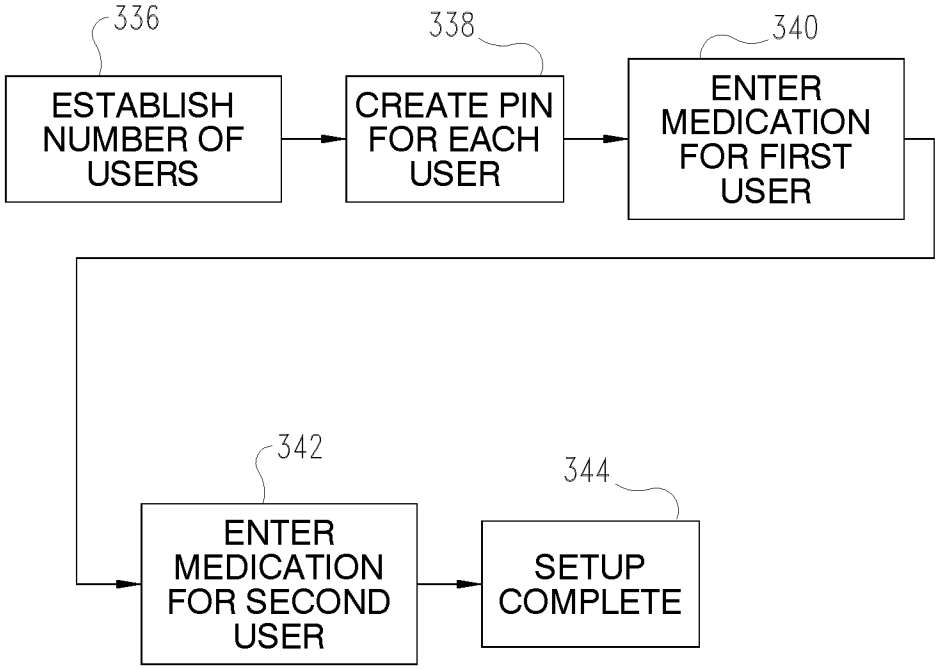

To address the limitations of the geometric transformation, another embodiment calibration process accomplishes coordinate system transformation using raw camera images such as in FIGS. 21A-21B and an array of high-contrast calibration points (corners) that are automatically detected during calibration. In FIG. 21A, bin 200 includes a grid 203*a* for a 0% calibration target with corners 205*a* of the grid indicated by the dots. In FIG. 21B, bin 200 includes a grid 203*b* for a 100% calibration target with the corners 205*b* marked with dots. As shown in FIG. 22, a pattern 207 is provided for bin 200 that includes the grid marked by different colored or shaded areas within the grid.

The calibration process first includes first collecting raw images of calibration targets for a range of fill heights, such as shown in FIGS. 20A-20E. Next, the calibration process includes generating a multi-point fill height array. This can include: 1) selecting a range of pixel X values that exists within the bin for all fill heights (e.g. sample of 5 pixel X coordinates); 2) for each fill height, automatically detecting and recording the maximum Y value of the calibration target at each sampled pixel X coordinate; and 3) curve fitting the maximum pixel Y value vs Z height for each sampled X coordinate. The calibration process then includes applying a corner detection algorithm to identify the pixel (X, Y) coordinates of all calibration corners (e.g. 49 corners in 7×7 array at 10 mm rho spacing and 2.5 degree theta spacing), such as shown in FIGS. 21A-21B.

The calibration process then includes deriving calibration corner pixels (X, Y) for measured and intermediate fill levels (Z-height). For each calibration corner, the process includes: 1) plotting and curve fitting pixel Y vs Z for all calibration Z heights; 2) using a curve fit model to predict pixel Y vs Z for all discrete Z heights; 3) plotting and curve fitting pixel X vs Z for all calibration Z heights; and 4) using a curve fit model to predict pixel Y vs Z for all discrete Z heights. The process then includes creating predicted pixel (X, Y) locations for all corners for all discrete Z heights.

Using this embodiment calibration process, during pill picking, the fill height is determined by generating the pill image, as before, and then finding the maximum pixel Y value at each of the sampled pixel X values. The pixel Y values are converted to Z-height at each sampled pixel X value using the derived curve fitting equation. Multiple samples are used to account for possible piling of the pills and for rounded contours at the pill-bin boundary. Once fill height is determined, it is rounded to a discrete Z height for which a calibration pixel (X, Y) lookup table exists. Once this is complete, transformation to (rho, theta) coordinates is reduced to a basic 2-dimensional grid interpolation. Because of the relatively large number of calibration corners, the corners of an individual grid element can be assumed to be a trapezoidal shape with negligible impact on accuracy.

The device 100 operates under computer control and has a touch screen interface in connection therewith. FIGS. 23A-23D show one embodiment setup routine 300 and additional functionality is described below. Upon start up a splash screen 302 is displayed as the system initializes or wakes up at 304. An animation can be displayed as well. Upon initial startup, or as needed thereafter, a welcome screen 306 is displayed. The user can select to see a tour showing features of the system or proceed with the setup wizard for configuring the system.

Upon selecting the setup wizard at 308, the user is shown a user agreement 310, and asked to read and agree thereto. Next, the user is asked at 312 to configure a wireless network, as noted above the system provides for wireless access for several purposes. The user is prompted to select a network at 314, provide authorizing credentials at 316, and a successful setup is indicated at 318 or the user is provided an opportunity to correct any mistakes in entering the credentials at 320. The user can then enter date and time settings at 322 and make any updates or corrections thereto at 324.

The user can then enter in a security code, or system key, at 326 which provides for secure access to the device 100 to only users that have the system key. The system key is required to perform system management activities such as loading and refilling medication. The user can then select at 328 whether to provide a contact for system key recovery, and enter at 330 in the name and contact information for one or more persons that serve as emergency contacts or that can help the user access the device in case the system key is forgotten. The user can selected at 332 one or more methods of contacting the key contact, including by text message, voice message, or email. The 334 the user can enter the notification information for the selected contact method. More than one notification method can be entered, and more than one key contacts can be entered. Once the information is entered, a verification screen displaying the entered information can be provided.

The user can then establish a number of users at 336 so that more than one user of device 100 is possible. A PIN for each user can be created at 338. User specific information is entered at 340 for the first user, and if more than one user, for the second user at 342. The user specific information can include the medications/pills that the device 100 will provide to the user(s). Each users is required to create a user PIN, which is a security code that is separate from the system key. Having a user PIN allows each user to retrieve medication and adjust basic preferences. The features accessible with a user PIN are significantly smaller than the features accessible with a system key.

The device 100 can be configured to provide the user with multiple chances to enter the system key. If the system key is incorrectly entered a predetermined number of times, the user can be prompted to reset their system key. Alternatively, if the user cannot remember the security key, an "I Forgot the Key" button or similar feature can be provided so that a temporary key will be sent to the recovery contact who can then assist in accessing the device 100.

New users can be added to the device 100 through a management screen, where users can be added, deleted, or user information can be updated. The system key must be entered, and the device 100 prompts the user through the various operations. The device 100 allows for configuring the notification settings for the various contacts, such as text, voice, and email settings. The contacts can be categorized as family members, caregivers, or the users of the device 100. The device 100 uses this information to suggest commonly used notification settings for that contact category. New contacts can be added as well, and existing contact information can be updated as needed. The user PIN can be changed for one or more of the device users. User nicknames can be changed, and users can be deleted.

The device 100 allows for entering information about the user's pills. For example, to add a new medication/pill, a manage medication screen can be accessed. The user can then enter a new medication by entering the system key, selecting the user associated with the medication, and then the information on the prescription label. The prescription information includes, for example, the recipient's name, the name of the medication (a look up table can be provided, and the system checks for duplicate entries), medication nickname, medication strength, dosage/directions for use (with meals, before or after meals, etc.), prescription quantity, refill information, and use-by-date. The location where the medication will be stored is selected at this point as well. This can include selecting a bin 200 (the system can prompt the user if no bins are available), or one of the other locations as described below. The schedule/frequency for taking the medication can be set up, including setting up a regular schedule, taken on an as-needed basis, or both. The information is used to allow the device to provide alerts when a medicine needs to be taken, and to prevent over and under use. The device allows for adjusting the schedule (regular or as needed) for any medication as well.

Once the medications have been added to memory they can be assigned to bins 200. The device 100 can allow for selecting the location for the medication, which could be a bin 200, the locked drawer 110, an external refrigerator, or an "other" location can be entered.

If a bin 200 is selected, the device 100 will notify the user if all the bins have already been assigned to a pill/medicine. If not, the device 100 moves the carousel 128 to place an available bin 200 at the bin access door 106, unlocks the bin access door 106 (the door is normally locked to prevent inadvertent access or tampering) and prompts the user to remove the bin 200. The device 100 allows the user to select and view on the display touch screen 102 a video that will show the loading process for the pills/medicine. Once the bin 200 is selected, the user is prompted to clean the bin 200, pour the pills in the bin 200, and replace the bin 200 back into its slot in the carousel 128.

The drawer 110 is loaded in the same manner. The load refrigerator and load other options allow the user to track the location of items that are not stored in the device 100 but are otherwise part of the user's regimen. For example, the user might have a medicine that is too large to fit into the device 100, but they can still enter a schedule for it, and enter in the location where it is stored (kitchen cabinet for example).

The device 100 can display a message indicating that a certificate provided by a monthly billing system has expired. Medication will continue to be dispensed if the certificate expires, but no medications can be loaded or refilled until the device 100 receives a valid certificate.

The device 100 allows the user to enter information associated with a prescription refill event. The user selects the manage meds/system menu, then the manage medication menu, and then the refill menu. The system key is entered, the applicable user selected, and the medication is selected from the user's list. The device 100 can also track whether this prescription can be refilled, or if the time limit for taking the medication has expired.

The user can remove a medication from the list. The user selects the manage meds/system menu, then the manage medication menu, and then the remove medication menu. The system key is entered, the applicable user selected, and the medication to be removed is identified from the list of available medications. If medication remains, the bin access door 106 is unlocked, and the user is prompted to remove the bin 200 and the medication therein.

The user can change the schedule for a medication. The user selects the manage meds/system menu, then the manage medication menu, and then the change medication schedule menu. The system key is entered, and the applicable user selected, and the medication to be changed is selected from the list. Then the process described above for entering in the information originally is repeated. This process can be used to change the days of the week, or the times of the day that the medication is taken.

The user can select to take a scheduled medication early if desired. The user selects the manage meds/system menu, then the manage medication menu, and then the get medication early menu. The system key is entered, and the applicable user selected, and the medication is identified and dispensed as described above. This process can be used for a single dose or multiple doses. The device 100 can also prompt the user to confirm the number of pills placed in the dispense cup and track any miscounts, or suspected mismatches between the actual number of pills dispensed and the number expected.

The user can also pause medication dispensing for a period of time, for example, if the user is away on vacation or at a health care facility. The user selects the manage meds/system menu, then the manage medication menu, and then the pause medication. The system security key is entered, and the applicable user selected, next the user identifies the medications to be paused on an individual basis or can select to pause all medications. In a similar manner, the user can also just view the medication schedule by selecting the review medication menu instead of the pause medication menu. The user can also check the count of pills in the bins by selecting the check fill status menu instead of the pause medication menu. The system tracks the number of pills in each bin, and this function helps the user to anticipate refills and the like. The user can also check the adherence to the pill schedule, by selecting the medication adherence tracker menu, and the device 100 will display the user's adherence/compliance over a predetermined period of time. These menu options all require the system key, and applicable user to be entered/selected.

The user can configure the device 100 for remote viewing of device information stored on the cloud by cloud users. This can be done through the manage meds/system menu, by selecting the manage system settings menu, and then the manage cloud user access menu. The system key must be entered. The user has three options at this point: invite new cloud user, enter code for pending user, and delete cloud user.

To invite a new user, his or her email address is entered, and a message is sent to that address with an activation code and information about setting up a cloud user account. Once the new user completes that process, the enter code for pending user option is selected, and the device user selects the email address and enters that registration code assigned to that user and then the user is approved. A user can be deleted by selecting the user's email address and deleting it, which will disable his or her ability to access device data stored on the cloud.

The system can pair the device with a remote wireless keyboard, using Bluetooth technology. The device audio/visual settings can also be adjusted. These include enabling/disabling audio tones, visual indicators, and touchscreen clicks. The system volume and screen brightness can be adjusted as well.

During operation, the device 100 can provide notice of scheduled dispenses. The device 100 generally will display upcoming dispenses for each user, including the next dose, dose time, and any special instructions (like take with meals). When a dispense time arrives the device 100 will display the notice and enable an audio alert. The user then selects his or her name from the user list, enters his or her user PIN, and the device 100 commences to dispense the pill into the dispense cup. If there are not enough pills, or the bin with the pills is not present or accessible, a notice to this effect is presented on the device screen. Similarly, if the pill could not be retrieved, a notice is shown allowing the user to cancel the dispense, manually retrieve the pill through the bin access door, or move to the next dispense.

If the pills are successfully dispensed, the user is prompted to remove the pills from the dispensing cup 114, and then asked to enter in the number of pills in the cup to ensure that no mistakes were made.

In a similar manner, the device 100 can generate an alert for taking a substance from the locked drawer 110. However, the bin dispensing mechanics do not operate since the dispensing does not come from the bins 200. The device 100 provides a visual and audio alert at the dispense time, and the user enters his or her user PIN after having been prompted. The drawer 110 is unlocked, and an alert will display if the device 100 detects that the drawer 110 is not timely opened.

The process for the refrigerator, or any other remote location entered into the device 100, is simpler. The device 100 provides a visual and audio alert at the dispense time, the user enters his or her user PIN after having been prompted, and is asked to acknowledge having retrieved the medication from the external location.

The device 100 may have additional settings for selecting color themes and font size, enabling or disabling voice features, and selecting the voice used for audio communications.

In this manner, the device 100 substantially eliminates the problems of the prior art. The device 100 comprises a user friendly, highly accurate, compliant device to manage a wide variety of pills and medication. The device 100 increases user's adherence to medication schedules, provides a reliable delivery method, and eliminates mistakes that can result in over or under medication. The device 100 also allows the user to interact with health care professionals, pharmacies, notifies care professionals in emergencies, loved ones, medication reorders, remote health diagnostic data and other as needed information.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A pill dispensing apparatus, comprising:

a carousel, wherein the carousel includes at least one removable bin for storing pills;

a vision system for identifying one or more pills within the at least one removable bin, wherein the vision system is configured to select a pill from the one or more pills in the at least one removable bin for retrieval;

a vacuum nozzle for removing the pill selected by the vision system, wherein the vacuum nozzle is movable relative to the at least one removable bin to place the vacuum nozzle directly over the selected pill; and a dispensing area for receipt of the selected pill removed by the vacuum nozzle.

2. The apparatus of claim 1, further comprising a computer controller configured for multiple users to independently access selected ones of a plurality of removable bins of the carousel.

3. The apparatus of claim 1, wherein the vision system includes a camera for imaging the one or more pills within the at least one removable bin.

4. The apparatus of claim 1, wherein the at least one removable bin includes a bar code readable by the vision system for verification purposes.

5. The apparatus of claim 1, wherein the vision system is operable to select the pill from the at least one removable bin in response to locating one or more candidate pills in three dimensional space in the at least one removable bin.

6. The apparatus of claim 1, further wherein the at least one removable bin includes a plurality of bins positioned radially around the carousel, wherein the carousel is rotatable to move a selected one of the bins in alignment with the vacuum nozzle, and wherein the vacuum nozzle is movable radially and vertically relative to the at least one removable bin to place the vacuum nozzle directly over the selected pill.

7. The apparatus of claim 6, further comprising a cover for covering the carousel and the plurality of bins.

8. The apparatus of claim 7, wherein the cover includes a bin access opening through which at least one of the bins from the carousel can be removed to load pills therein.

9. The apparatus of claim 8, wherein the cover has a top opening through which the vision system and vacuum nozzle can move into the aligned bin for removal of the one or more pills.

10. The apparatus of claim 9, wherein the carousel has a blank bin location to align with the top opening in the cover thereby comprising a home position.

11. The apparatus of claim 1, further comprising a computer controller configured to operate the vision system and the vacuum nozzle.

12. The apparatus of claim 11, further comprising a touch screen to interface between the computer controller and a user.

13. The apparatus of claim 12, further comprising a cover for covering the carousel and the plurality of bins and a camera adjacent the touchscreen, the camera being set on the cover with hinges and the camera is movable between an open position and a closed position.

14. A pill dispensing apparatus, comprising:

a carousel, wherein the carousel includes a plurality of removable bins for storing pills that are positioned radially around the carousel;

a vision system for identifying one or more pills within the at least one removable bin;

a vacuum nozzle for removing one or more pills identified by the vision system; and a dispensing area for receipt of the one or more pills removed by the vacuum nozzle, wherein the carousel is rotatable to move a selected one of the bins in alignment with the vacuum nozzle and further comprising a radial stage for moving the vision system and the vacuum nozzle radially back and forth on the carousel between the selected bin and the dispensing area.

15. The apparatus of claim 14, further comprising a Z-stage for moving the vision system and the vacuum nozzle in a Z direction into the selected bin for engaging a pill in the selected bin with the vacuum nozzle and for withdrawing the engaged pill from the selected bin.

16. The apparatus of claim 15, wherein the dispensing area is located outside the radial perimeter of the carousel and bins.

17. A pill dispensing apparatus, comprising:

a carousel, wherein the carousel includes at least one removable bin for storing pills;

a vision system for identifying one or more pills within the at least one removable bin;

a vacuum nozzle for removing one or more pills identified by the vision system;

a dispensing area for receipt of the one or more pills removed by the vacuum nozzle; and an outer cover enclosing the carousel, the outer cover including a bin access door for accessing the at least one removable bin, and a dispensing cup in the dispensing area.

18. A pill dispensing apparatus, comprising:

a carousel, wherein the carousel includes at least one removable bin for storing pills;

a vision system for identifying one or more pills within the at least one removable bin;

a vacuum nozzle for removing one or more pills identified by the vision system;

a dispensing area for receipt of the one or more pills removed by the vacuum nozzle;

an absolute encoder disc on the carousel for sensing by an absolute rotary position sensor so that the at least one removable bin can be located relative to the vision system without a home reference for location of the carousel.

19. A pill dispensing apparatus, comprising:

a carousel, wherein the carousel includes at least one removable bin for storing pills;

a vision system for identifying one or more pills within the at least one removable bin;

a vacuum nozzle for removing one or more pills identified by the vision system;

a dispensing area for receipt of the one or more pills removed by the vacuum nozzle; and a lockable drawer below the carousel.

20. The apparatus of claim 19, further comprising a bin access door for accessing the at least one removable bin, wherein the bin access door is lockable.

* * * * *